US010512340B2

(12) United States Patent
Jewett et al.

(10) Patent No.: US 10,512,340 B2
(45) **Date of Patent: *Dec. 24, 2019**

(54) POCKETED SPRING ASSEMBLY COMPRISING STRINGS OF SPRINGS WITH TABS

(71) Applicant: L&P Property Management Company, South Gate, CA (US)

(72) Inventors: Jason Jewett, Carthage, MO (US); Austin G. Long, Sarcoxie, MO (US); Darrell A. Richmond, Carthage, MO (US)

(73) Assignee: L&P Property Management Company, South Gte, CA (US)

( * ) Notice: Subject to any disclaimer, the term of this patent is extended or adjusted under 35 U.S.C. 154(b) by 363 days.

This patent is subject to a terminal disclaimer.

(21) Appl. No.: 15/609,544

(22) Filed: May 31, 2017

(65) Prior Publication Data

US 2018/0344045 A1 Dec. 6, 2018

(51) Int. Cl.
*A47C 27/06* (2006.01)
*A47C 27/05* (2006.01)

(52) U.S. Cl.
CPC ..... *A47C 27/064* (2013.01); *A47C 27/056* (2013.01)

(58) Field of Classification Search
CPC ..... A47C 7/34; A47C 21/046; A47C 27/06; A47C 27/064; A47C 27/056; A47G 9/00; B68G 9/00
See application file for complete search history.

(56) References Cited

U.S. PATENT DOCUMENTS

| | | | | |
|---|---|---|---|---|
| 2,595,840 | A * | 5/1952 | Gleason | A47C 27/04 5/251 |
| 4,234,984 | A | 11/1980 | Stumpf | |
| 5,957,438 | A | 9/1999 | Workman et al. | |
| 6,966,091 | B2 | 11/2005 | Barber | |
| 7,048,263 | B2 * | 5/2006 | Ahlqvist | B68G 9/00 267/91 |
| 7,748,065 | B2 * | 7/2010 | Edling | A47C 27/064 5/720 |
| 8,087,114 | B2 * | 1/2012 | Lundevall | A47C 27/063 267/166 |
| 8,857,799 | B2 * | 10/2014 | Tyree | A47C 27/064 5/720 |
| 8,978,183 | B1 * | 3/2015 | Richmond | A47C 27/062 5/655.8 |

(Continued)

FOREIGN PATENT DOCUMENTS

| | | |
|---|---|---|
| EP | 3167768 | 5/2017 |
| WO | 2015144836 | 10/2015 |

*Primary Examiner* — Nicholas F Polito
*Assistant Examiner* — Rahib T Zaman
(74) *Attorney, Agent, or Firm* — Wood, Heron & Evans, LLP

(57) ABSTRACT

A pocketed spring assembly comprises a plurality of parallel strings of springs held together with tabs. Longitudinal seams joining overlapping tabs extend generally the same direction as the strings of springs. Pockets are formed along a string of springs by aligned separating seams. At least one spring is positioned in each pocket. Each separating seam joins opposed plies of the string and keeps the spring in its pocket. Ends of aligned separating seams are spaced from each other, thereby improving airflow between pockets.

20 Claims, 22 Drawing Sheets

(56) References Cited

U.S. PATENT DOCUMENTS

| | | | | |
|---|---|---|---|---|
| 9,427,092 | B2 | 8/2016 | Wolfson | |
| 10,334,958 | B2 * | 7/2019 | Wyler | A47C 27/064 |
| 2003/0110566 | A1 | 6/2003 | Stumpf | |
| 2007/0124865 | A1 * | 6/2007 | Stjerna | A47C 27/064 5/720 |
| 2010/0212090 | A1 * | 8/2010 | Stjerna | A47C 27/064 5/720 |
| 2016/0015183 | A1 | 1/2016 | Stjerna | |
| 2016/0045034 | A1 | 2/2016 | Hager et al. | |
| 2016/0220033 | A1 | 8/2016 | Mossbeck et al. | |
| 2017/0008756 | A1 * | 1/2017 | Clare | A47C 27/064 5/720 |

* cited by examiner

POCKETED SPRING ASSEMBLY COMPRISING STRINGS OF SPRINGS WITH TABS

FIELD OF THE INVENTION

This invention relates generally to bedding and seating products and, more particularly, to pocketed spring assemblies used in bedding and seating products.

BACKGROUND OF THE INVENTION

Mattress spring core construction over the years has been a continuously improving art with advancements in materials and machine technology. A well-known form of spring core construction is known as a Marshall spring construction wherein metal coil springs are encapsulated in individual pockets of fabric and formed as elongate or continuous strings of pocketed coil springs. In an earlier form, these strings of coil springs were manufactured by folding an elongated piece of fabric in half lengthwise to form two plies of fabric and stitching transverse and longitudinal seams to join the plies of fabric to define pockets within which the springs were enveloped.

More recently, improvements in spring core constructions have involved the use of fabrics which are thermally or ultrasonically weldable to themselves. By using such welding techniques, these fabrics have been advantageously used to create strings of individually pocketed coil springs wherein transverse and longitudinal welds, instead of stitching, are used to form the pockets encapsulating the springs. One such fabric is a non-woven polypropylene fabric.

One of the long recognized advantages of bedding or seating products incorporating springs when compared to bedding or seating products made of foam is the coolness or lower temperature of the product. In other words, when a user sleeps on a mattress made with coil springs, the sleep surface is cooler than the sleep surface of a mattress made with foam. However, a mattress made with pocketed coil springs may be warmer than a mattress made with conventional springs.

Once strings of pocketed springs are constructed, adjacent strings are typically glued together to form a pocketed spring assembly of the desired size for a mattress, cushion or the like. For example, multiple strings may be arranged in a row pattern corresponding to the desired size and shape of a mattress or the like, and adjacent strings of strings glued together. The result is a unitary assembly of pocketed coil springs serving as a complete spring core assembly. However, the weak point in the pocketed spring assembly is along the glue lines.

Therefore, there remains a need for a pocketed spring assembly which incorporates multiple strings of springs without using glue, thereby providing a stronger pocketing spring assembly.

There is also a need for a pocketed spring assembly for use in a bedding or seating product having improved or increased airflow through the pocketed spring assembly to cool the pocketed spring assembly.

SUMMARY OF THE INVENTION

In one aspect, a bedding or seating product comprising a pocketed spring assembly is provided. The pocketed spring assembly comprises a piece of fabric folded to create first and second plies of fabric on opposite sides of a row of springs. The piece of fabric is further folded to create first and second tabs on opposite sides of the string of springs. Each of the strings of springs is joined to at least one adjacent string of springs by at least one longitudinal seam joining overlapping tabs of adjacent strings of springs. In some embodiments, at least two longitudinal seams separate each string of springs from an adjacent string of springs. In other embodiments, one longitudinal seam separates adjacent strings of pocketed springs.

Pockets are formed along each string of springs by separating seams. Each of the separating seams joins the first ply of fabric to the second ply of fabric. One of the separating seams extends downwardly from an upper surface of the string and an aligned separating seam extends upwards from a lower surface of the string. Each of the separating seams is approximately one third of the height of the pocketed springs; less than half the height of the pocketed springs. Aligned separating seams of such length provide a gap between ends of the aligned separating seams. Upon assembly, these gaps increase in width, thereby improving air flow between adjacent pockets. The air may flow freely through the gaps between adjacent pockets.

At least one spring is positioned in each of the pockets. For purposes of this document, a spring may be a metal coil spring, another form of metal spring, a foam cylinder, a foam member, any other known resilient member or any combination thereof. Each of the pocketed springs may have the same height or the pocketed springs may be different heights.

Cushioning materials may be placed over one or both sides of the pocketed spring assembly. Any known covering may encase the pocketed spring assembly and cushioning materials.

The strings of springs extend generally in the same direction as the longitudinal seams. This direction may extend longitudinally which, in a bedding product such as a mattress, is from head-to-foot. Alternatively, the strings of springs and longitudinal seams of the pocketed spring assembly may extend transversely or from side-to-side in a bedding product.

A bedding product incorporating a pocketed spring assembly in accordance with the present invention may be single-sided or double-sided. A bedding or seating product in accordance with the present invention may be posturized into regions or zones of different firmness by incorporating different springs into the pockets of one of the pocketed spring assemblies or by changing the number of longitudinal seams joining adjacent strings.

In another aspect, a pocketed spring assembly for a bedding or seating product is provided. The pocketed spring assembly comprises a plurality of strings of springs. Each of the strings comprises a row of springs and a piece of fabric surrounding the row of springs. The piece of fabric is joined to itself along at least one longitudinal seam. The piece of fabric has opposed plies and opposed tabs on opposite sides of the springs. Pockets are formed along each string by first and second separating seams. Each of the first and second separating seams joins opposed plies of the fabric. At least one spring, such as a coil spring for example, is positioned in each of the pockets. Each of the first separating seams is spaced from a corresponding second separating seam to partially separate open adjacent pockets, thereby allowing air to flow between adjacent pockets. Each of the strings is joined to at least one adjacent string by at least one longitudinal seam joining overlapping tabs of adjacent strings.

In the embodiments in which multiple longitudinal seams separate adjacent strings, air further cools the pocketed spring assembly by flowing through openings between adjacent longitudinal seams between adjacent strings. Each of these openings extends through the first and second layers or sheets of fabric and allows air to flow through the interior of the pocketed spring assembly to further cool the pocketed spring assembly.

In another aspect, a pocketed spring assembly for a bedding or seating product is provided. The pocketed spring assembly comprises a piece of fabric folded to create opposed plies of fabric and opposed tabs on opposite sides of a row of springs. Pockets are formed along a string by first and second separating seams. Each of the first separating seams joins the first sheet of fabric to itself. Each of the first and second separating seams joins the piece of fabric to itself. At least one spring is positioned in each of the pockets. Each of the first separating seams is aligned with and spaced from a corresponding second separating seam to partially open each of the pockets, thereby allowing air to flow between adjacent pockets. Although the springs are usually conventional metal springs, such as coil springs, the springs may be any resilient elements, such as pieces of foam, for example. At least one tab of each of the strings is joined to at least one tab of at least one adjacent string by longitudinal seams.

The accompanying drawings, which are incorporated in and constitute a part of this specification, illustrate embodiments of the invention and, together with the summary of the invention given above, and the detailed description of the drawings given below, explain the principles of the present invention.

BRIEF DESCRIPTION OF THE DRAWINGS

FIG. 3AA is a cross-sectional view of a portion of another pocketed spring assembly being assembled.

FIG. 3BB is a cross-sectional view of the pocketed spring assembly of FIG. 3AA assembled.

FIG. 8AA is a cross-sectional view of a portion of another pocketed spring assembly being assembled.

FIG. 8BB is a cross-sectional view of the pocketed spring assembly of FIG. 3AA assembled.

DETAILED DESCRIPTION OF THE INVENTION

Figure 1:
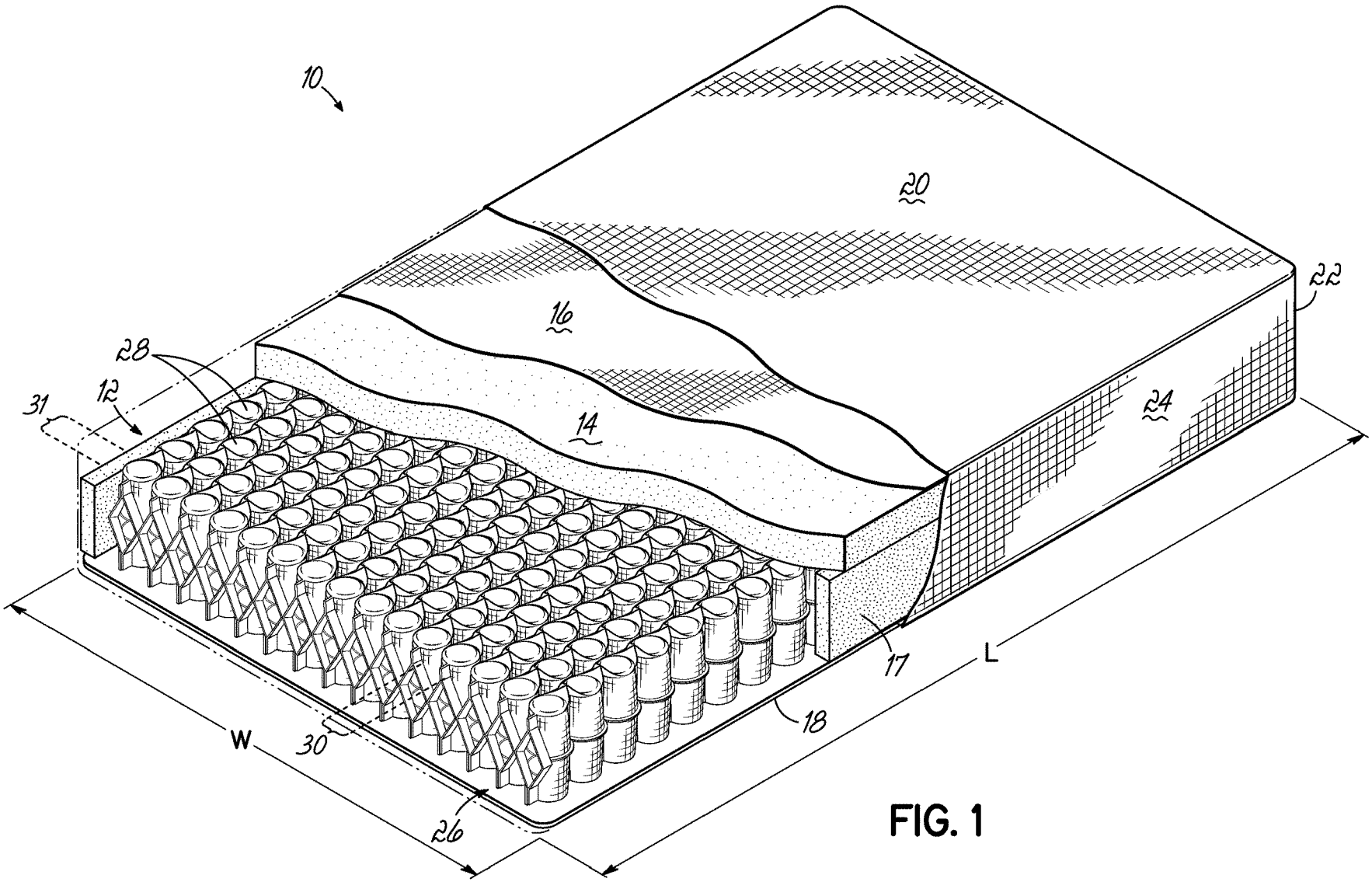
FIG. 1 is a perspective view, partially broken away, of a single-sided bedding or seating product incorporating one embodiment of pocketed spring assembly according to the principles of the present invention.

Referring to FIG. 1, there is illustrated a bedding product in the form of a single-sided mattress 10 incorporating one of the pocketed spring assemblies 12 of the present invention. Bedding product or mattress 10 comprises conventional padding or cushioning layers 14, 16, which may be foam, fiber, gel, a pocketed spring blanket or any other suitable materials or any combination thereof, laying over pocketed spring assembly 12. The pocketed spring assembly 12 is surrounded with a border 17 made of foam or any other suitable material (only a portion being shown in FIG. 1).

Although one type of border 17 is illustrated, the border may assume other forms or shapes of any desired size, such as pocketed coil springs. Alternatively, border 17 or any border may be omitted in any embodiment described or shown herein. This complete assembly is mounted upon a base 18 and is completely enclosed within cover 20 made from any known material such as an upholstered covering material. The base 18 and border 17 are known in the industry as a "bucket" into which a pocketed spring assembly 12 is inserted before the "bucket" is covered with one or more padding or cushioning layers.

As shown in FIG. 1, fully assembled, bedding product 10 has a length "L" defined as the linear distance between opposed end surfaces 22 (only one being shown in FIG. 1). Similarly, the assembled product 10 has a width "W" defined as the linear distance between opposed side surfaces 24 (only one being shown in FIG. 1). In the product shown in FIG. 1, the length is illustrated as being greater than the width. However, it is within the scope of the present invention that the length and width may be identical, as in a square product.

As shown in FIG. 1, pocketed spring assembly 12 is manufactured from multiple strings 26 of pocketed springs 28. Each string 26 of pocketed spring assembly 12 extends longitudinally or from head-to-foot along the full length "L" of product 10.

Figure 1A:
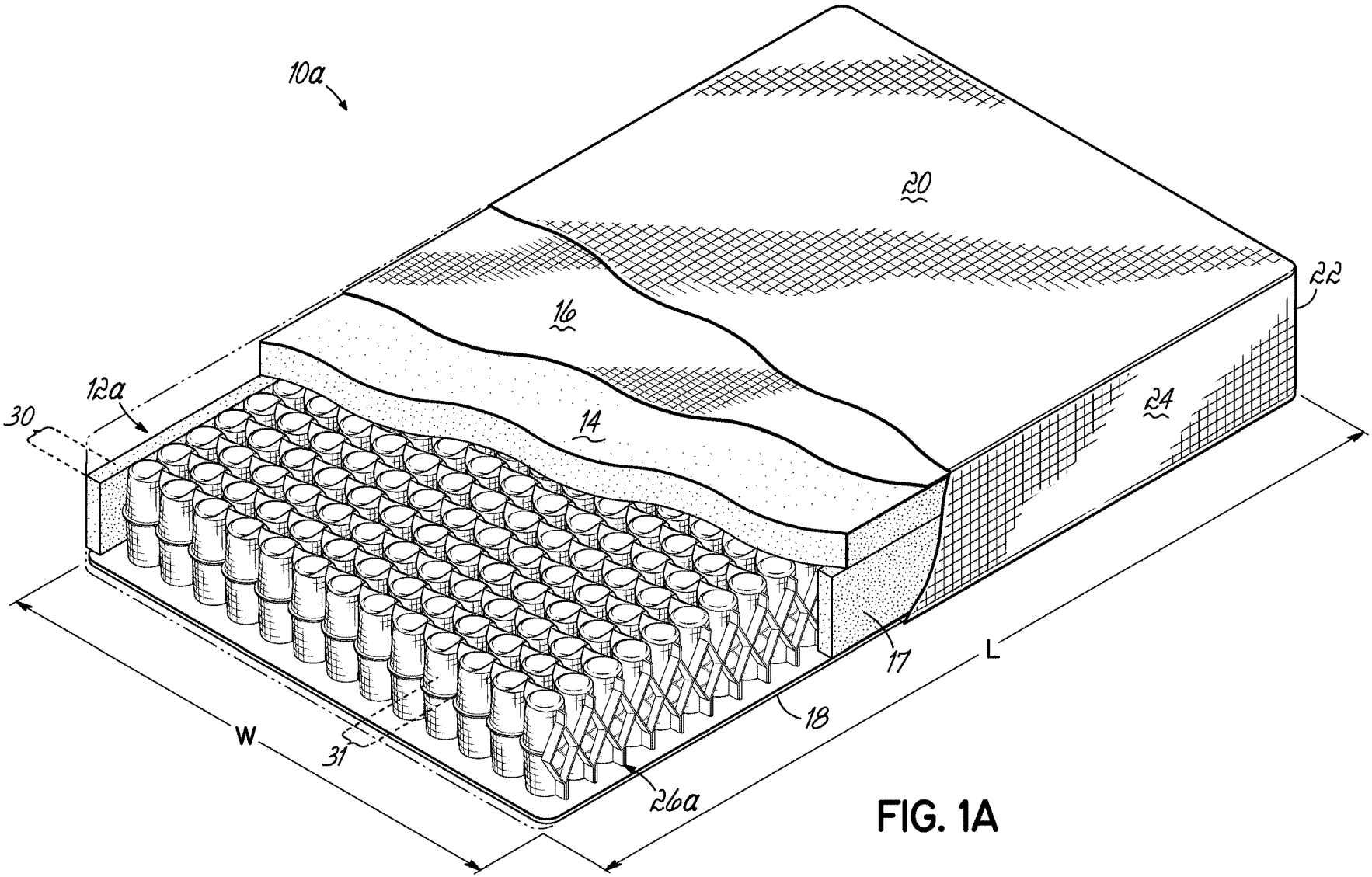
FIG. 1A is a perspective view, partially broken away, of a single-sided bedding or seating product incorporating another pocketed spring assembly.

Although the strings 26 extend longitudinally or from head-to-foot in the pocketed spring assembly 12 of FIG. 1, strings 26*a* may extend transversely or from side-to-side as shown in the pocketed spring assembly 12*a* shown in the product 10*a* shown in FIG. 1A. Pocketed spring assembly 12*a* comprises multiple strings 26*a* of pocketed springs, identical to the strings 26, but shorter in length.

Figure 1B:
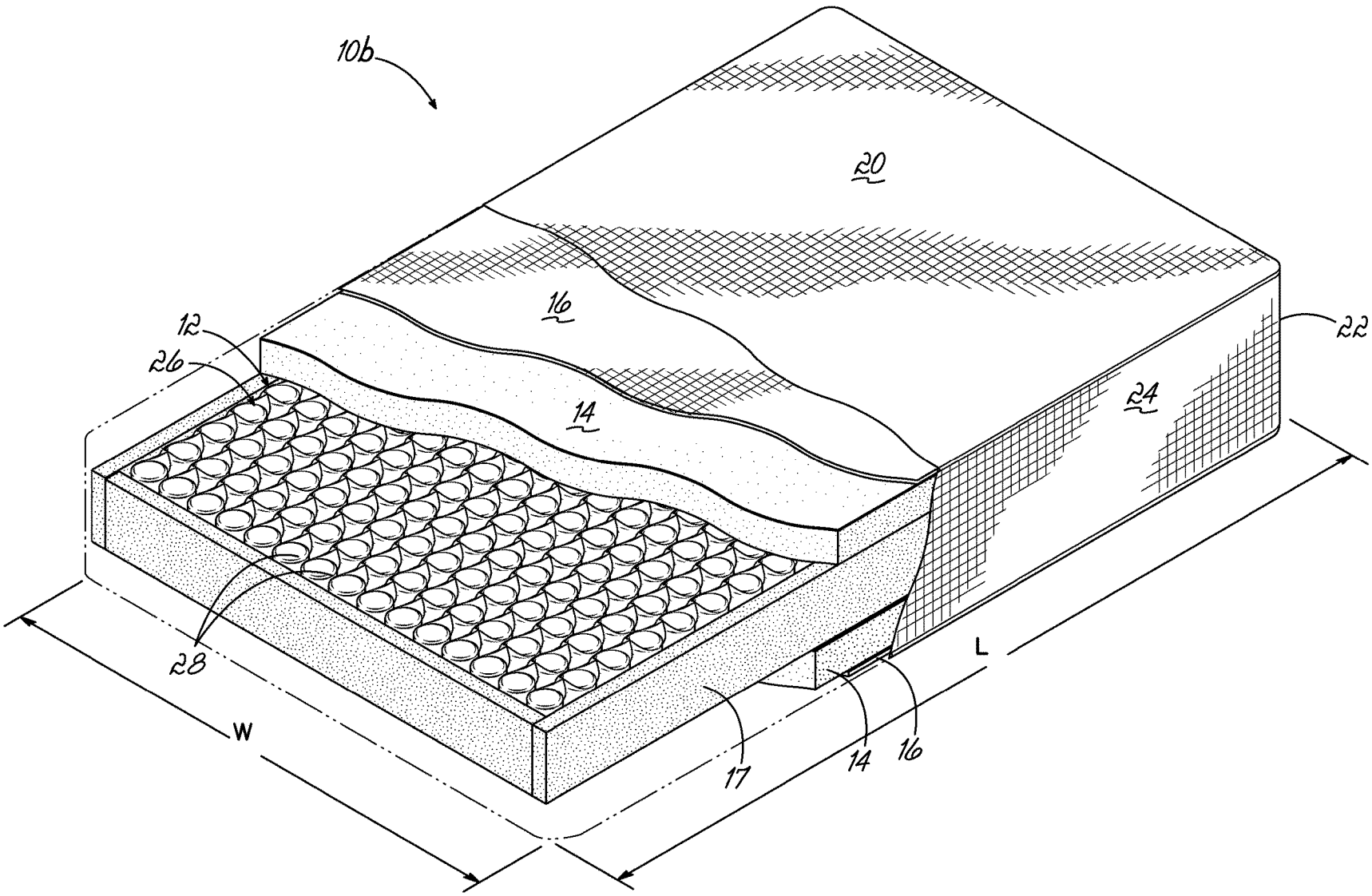
FIG. 1B is a perspective view, partially broken away, of a double-sided bedding product incorporating another pocketed spring assembly.

FIG. 1B illustrates a double-sided mattress 10*b* comprising a pocketed spring assembly 12 and border 17 identical to those shown in the mattress 10 of FIG. 1. However, the mattress 10*b* of FIG. 1B has conventional padding layers 14, 16 above and below pocketed spring assembly 12. The pocketed spring assembly 12 comprises the same strings 26 of pocketed springs 28 as those shown in FIGS. 1, 1B and 1C.

Figure 1C:
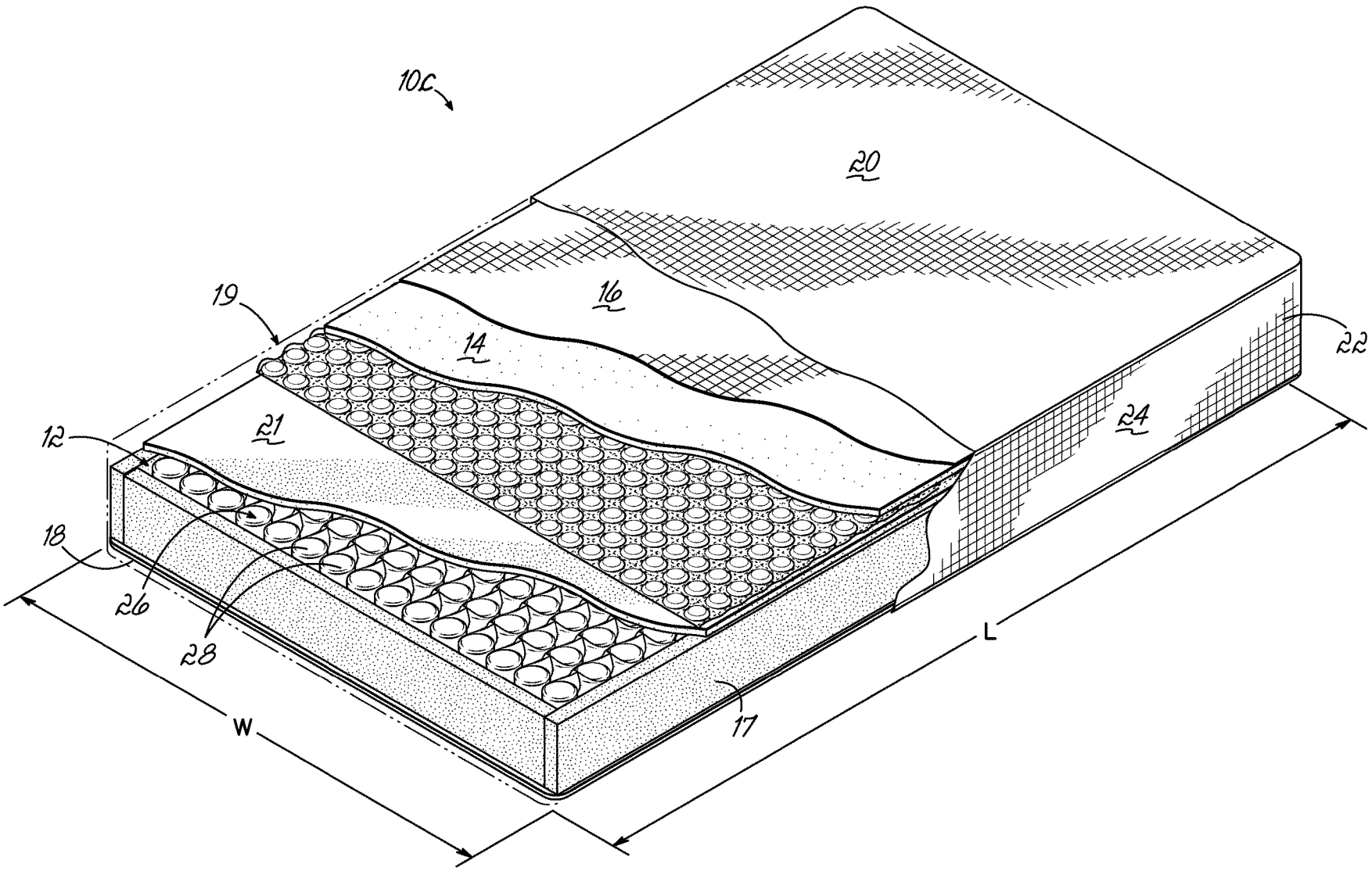
FIG. 1C is a perspective view, partially broken away, of another single-sided bedding product incorporating the pocketed spring assembly of FIG. 1.

FIG. 1C illustrates a single-sided mattress 10*c* comprising a pocketed spring assembly 12 and border 17 identical to those shown in the mattress 10 of FIG. 1. However, the mattress 10*c* of FIG. 1C has a pocketed topper 19 employing miniature or small pocketed coil springs in addition to padding layers 14, 16 above the pocketed topper 19. A scrim layer 21 separates the pocketed topper 19 from the pocketed spring assembly 12. Although one configuration of pocketed topper 19 is illustrated, any known pocketed topper may be used.

Figure 1D:
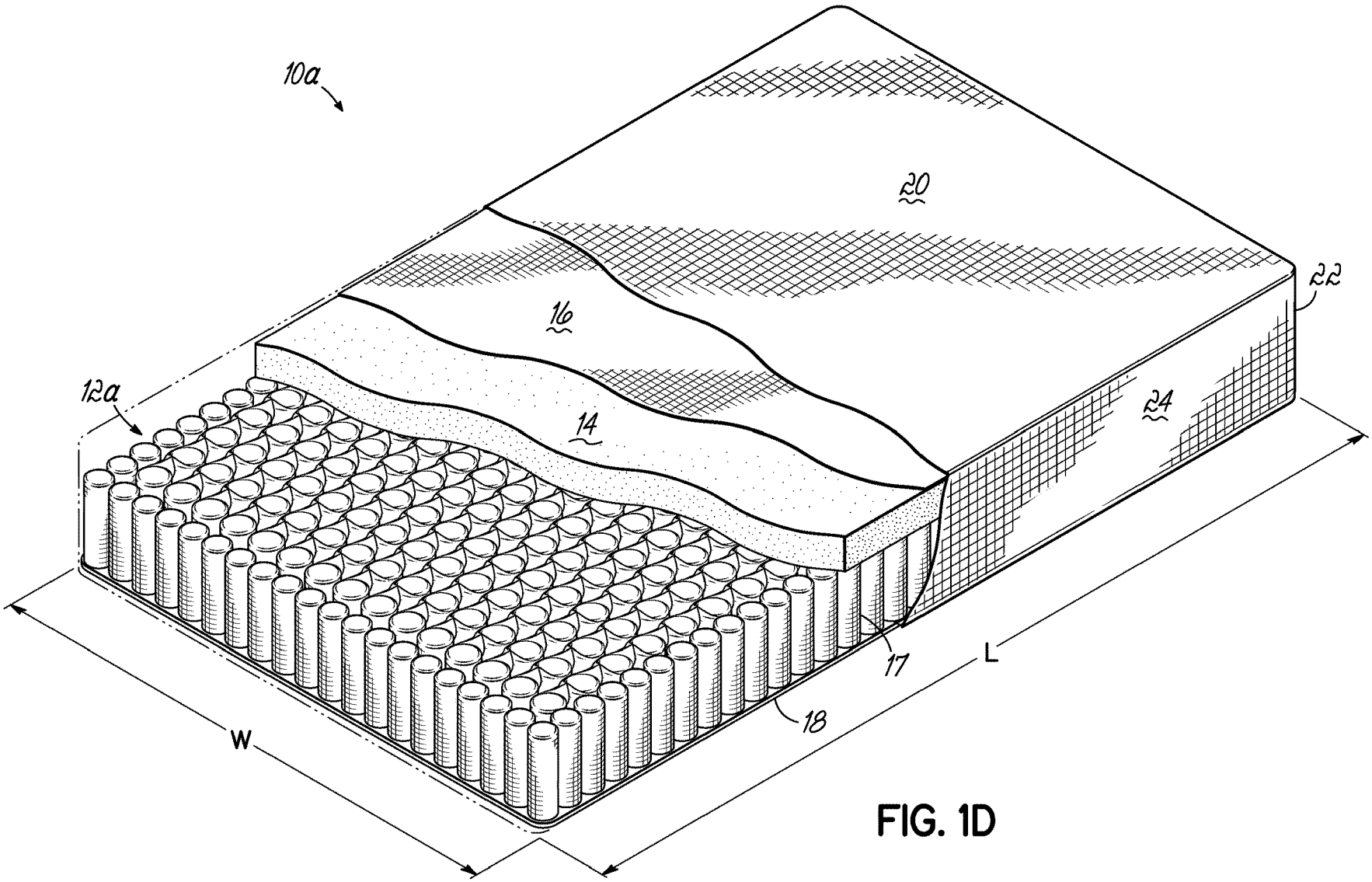
FIG. 1D is a perspective view, partially broken away, of another single-sided bedding product incorporating the pocketed spring assembly of FIG. 1.

FIG. 1D illustrates a single-sided mattress 10*d* comprising pocketed spring assembly 12*d*. In place of a foam border 17, a border comprising one layer of pocketed coil springs 29 surrounds the perimeter of an interior portion of pocketed spring assembly 12*d* and functions as edge support. Although a single perimeter layer of pocketed coil springs 29 is illustrated in FIG. 1D as a portion of pocketed spring assembly 12*d*, additional layers of edge support pocketed coil springs 29 may be incorporated into any of the pocketed spring assemblies shown or described herein.

Although FIG. 1D shows perimeter pocketed coil springs 29 being the same height as the interior portion of pocketed spring assembly 12*d*, the pocketed coil springs 29 functioning as edge support may be shorter or taller than the height of the pocketed springs of an interior portion of pocketed spring assembly they surround. In some applications, rather than surrounding all four sides of a pocketed spring assembly portion, pocketed coil springs 29 functioning as edge support may only extend along two opposed sides of the pocketed spring assembly.

In accordance with this invention, any of the padding or cushioning layers, including the pocketed topper 19, may be omitted in any of the products shown or described herein. The novel features reside in the pocketed spring assembly.

These strings of pocketed springs 26 and 26*a*, and any other strings of springs described or shown herein, may be connected in side-by-side relationship without the use of glue, thereby improving the strength of the pocketed spring assembly. In some embodiments, each string is formed using multiple sheets of fabric surrounding a row of springs. Unlike known prior art pocketed spring assemblies, adjacent strings are not joined using glue.

Figure 2:
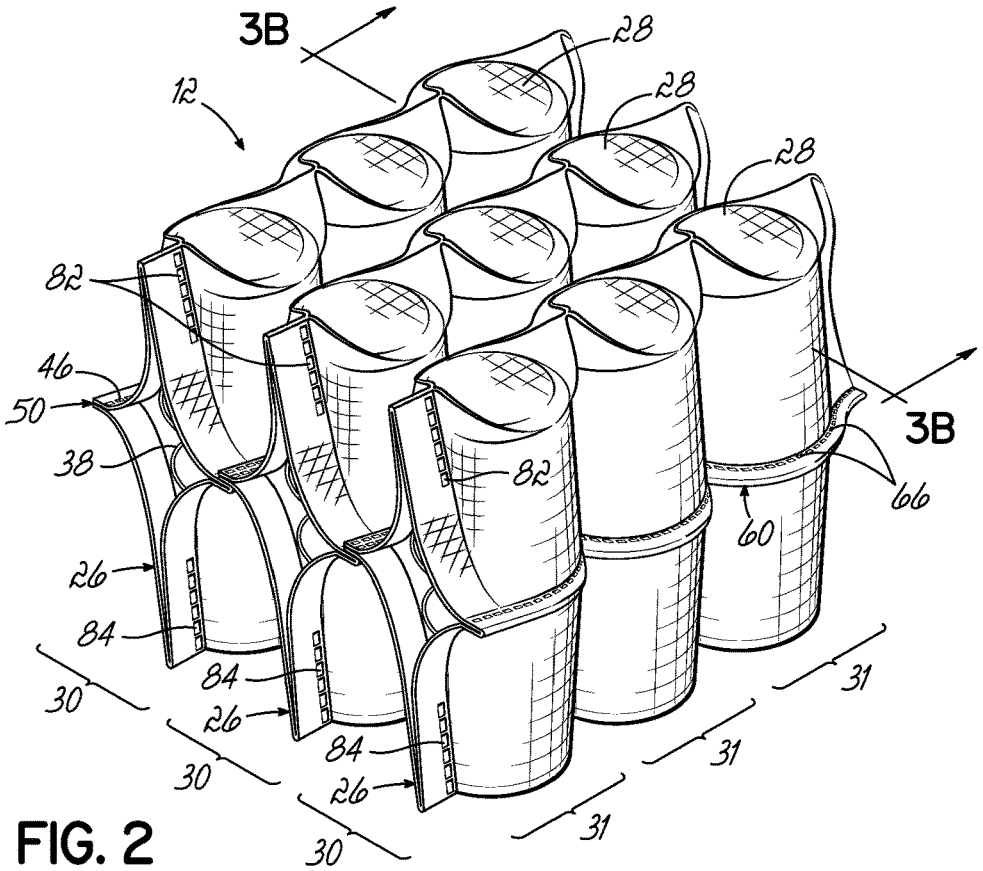
FIG. 2 is a perspective view of a portion of the pocketed spring assembly of FIG. 1 in a relaxed condition.

Referring to FIG. 2, the strings 26 may be joined so that the individually pocketed springs 28 are aligned in rows 30 and columns 31 in pocketed spring assembly 12. This alignment of strings may be incorporated into any of the pocketed spring assemblies illustrated or described herein.

Figure 2A:
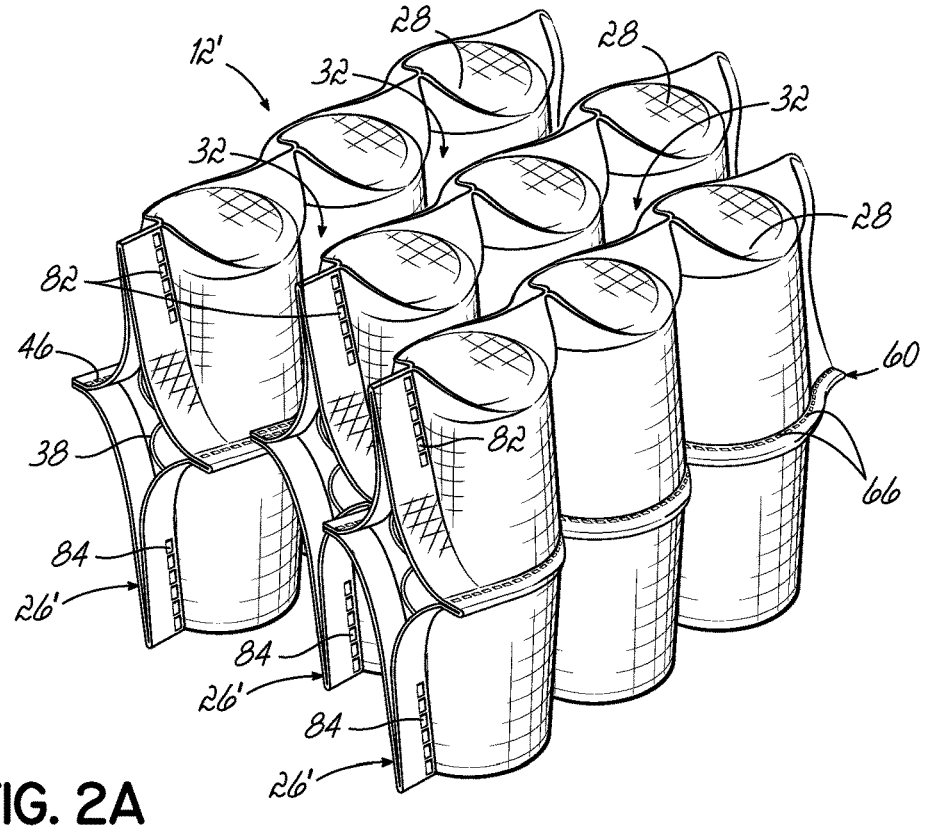
FIG. 2A is a perspective view of a portion of another pocketed spring assembly in accordance with the present invention, the rows of springs being offset from one another.

Alternatively, as shown in FIG. 2A, strings 26' of pocketed springs 28 may be offset from one another in a pocketed spring assembly. In such an arrangement, shown in FIG. 2A, the individually pocketed springs are not aligned in rows and columns; instead the individually pocketed springs fill gaps or voids 32 of the adjacent rows 26' of pocketed springs. FIG. 2A shows a portion of a pocketed spring assembly 12' with multiple strings 26' arranged in this manner. This alignment of strings may be incorporated into any of the pocketed spring assemblies illustrated or described herein.

Figure 3A:
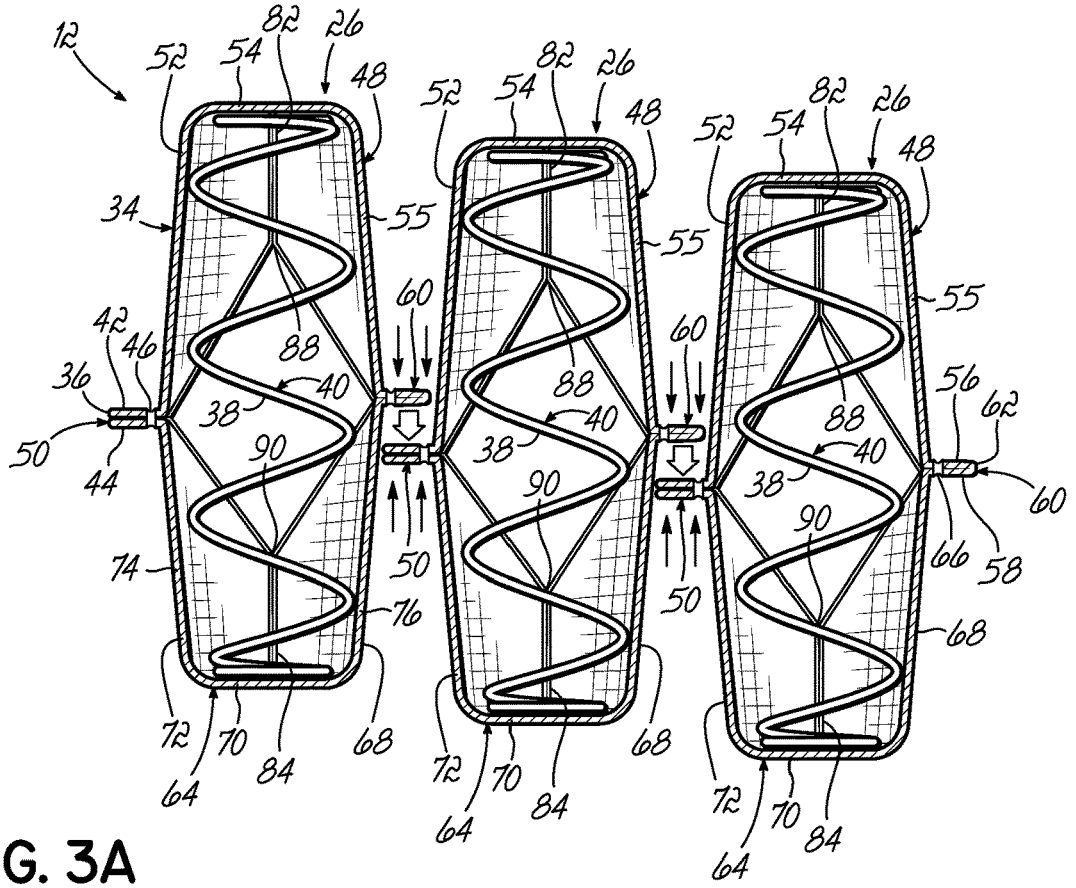
FIG. 3A is a cross-sectional view of a portion of a pocketed spring assembly being assembled.
Figure 3B:
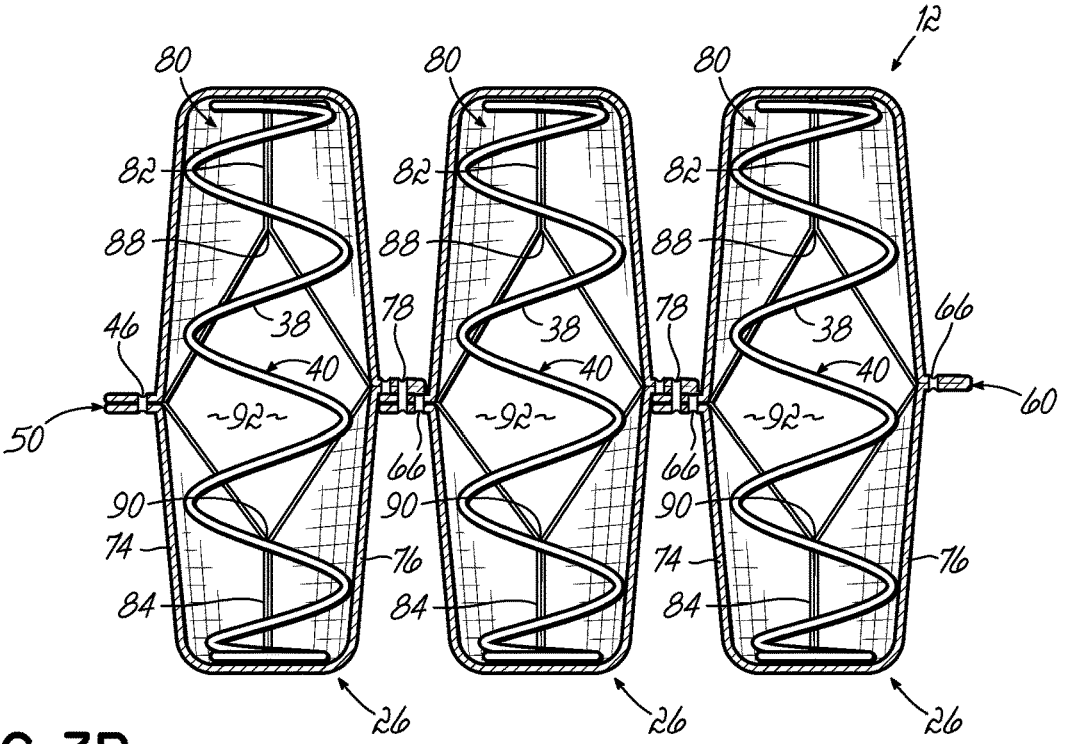
FIG. 3B is a cross-sectional view of the portion of the pocketed spring assembly of FIG. 3A assembled.
Figure 3A:
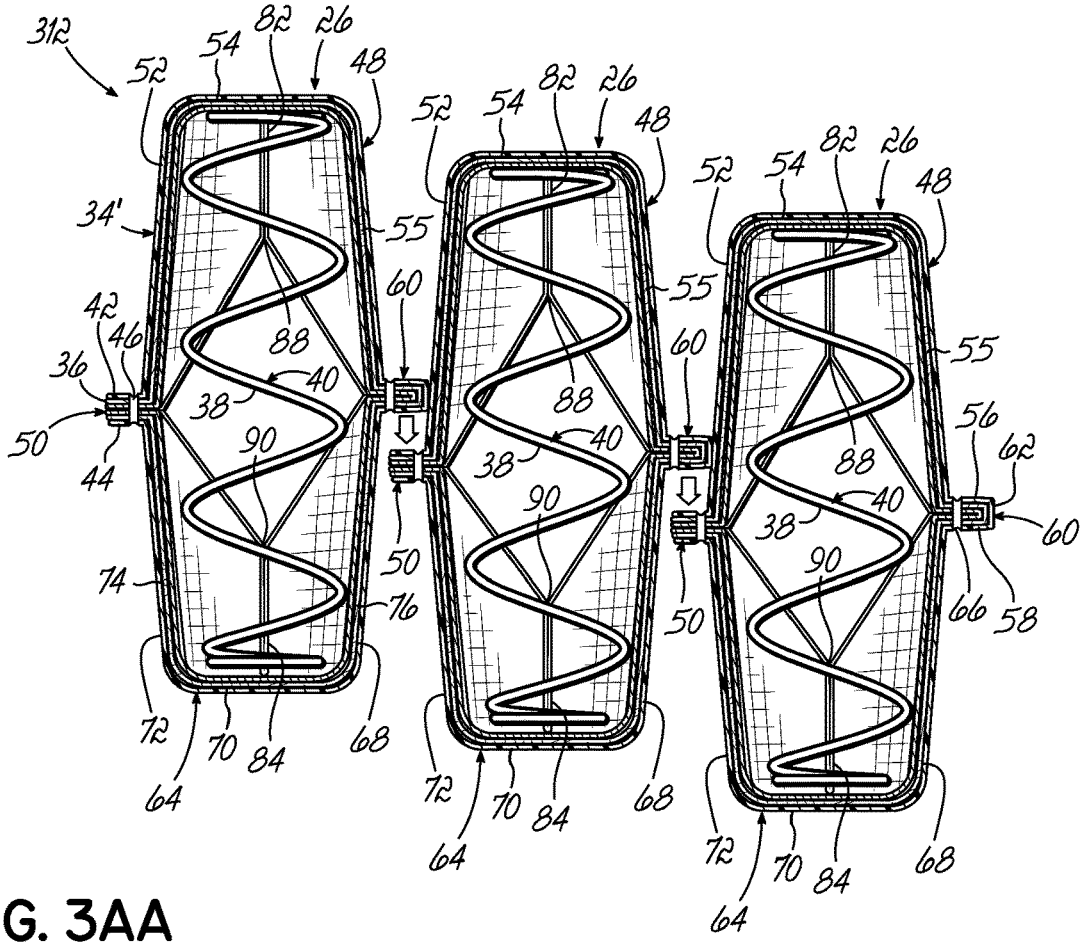
Figure 3B:
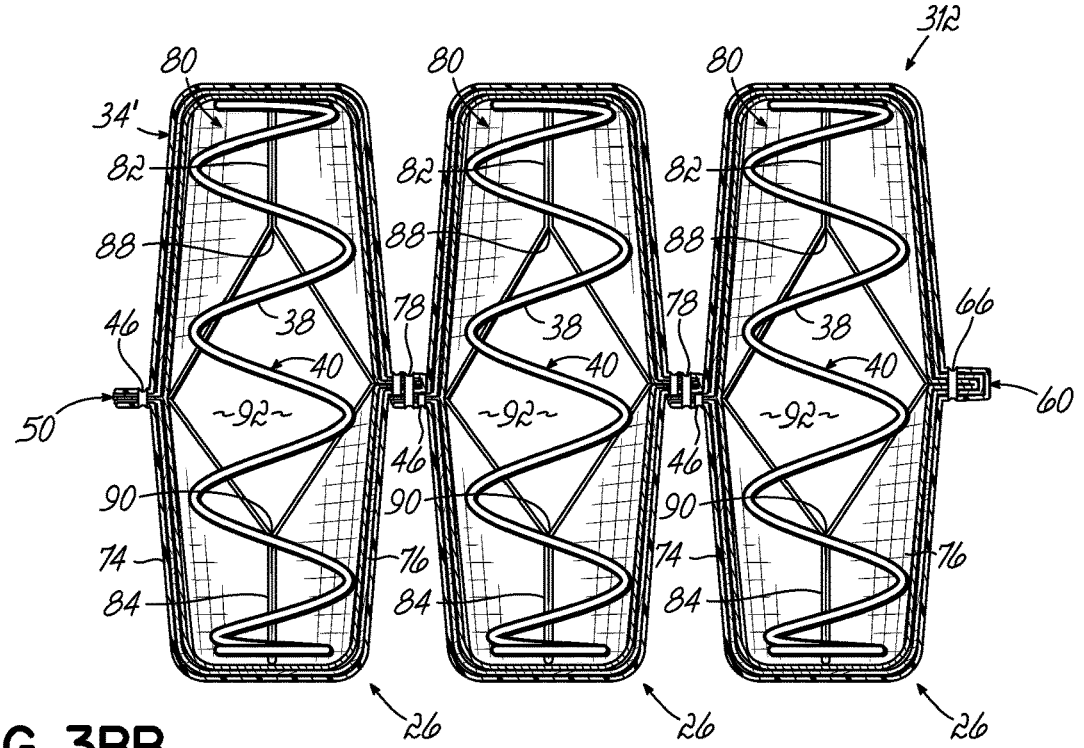
Figure 4:
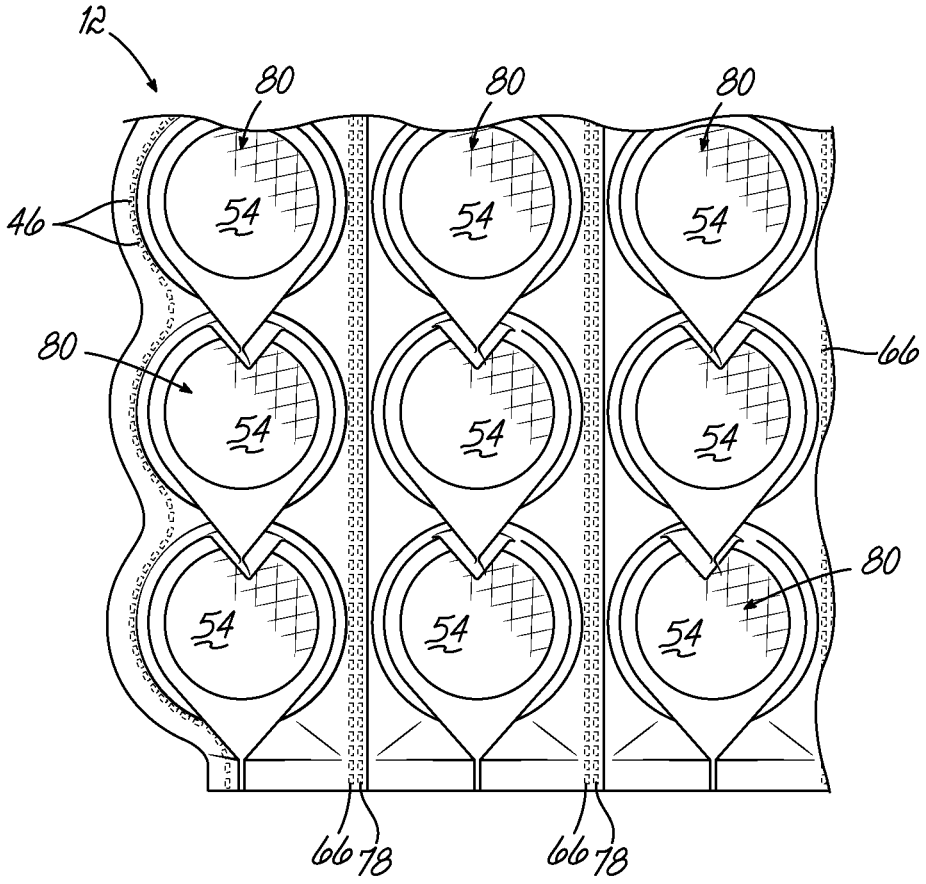
FIG. 4 is a top view of a portion of the pocketed spring assembly of FIG. 1 in a relaxed condition.
Figure 5:
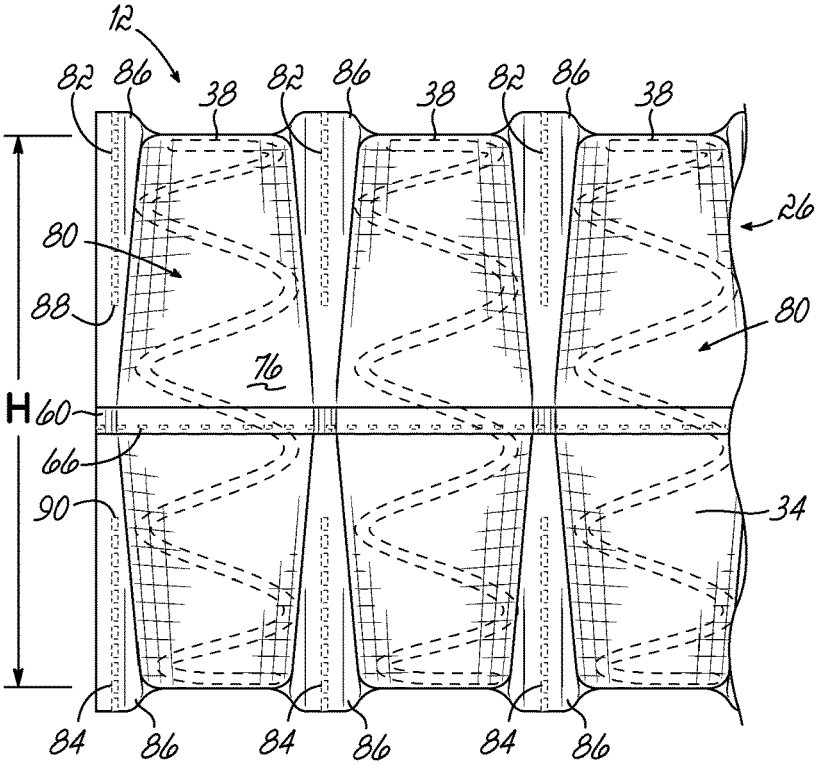
FIG. 5 is a side elevational view of a string of the portion of the pocketed spring assembly of FIG. 4 in a relaxed condition.
Figure 6:
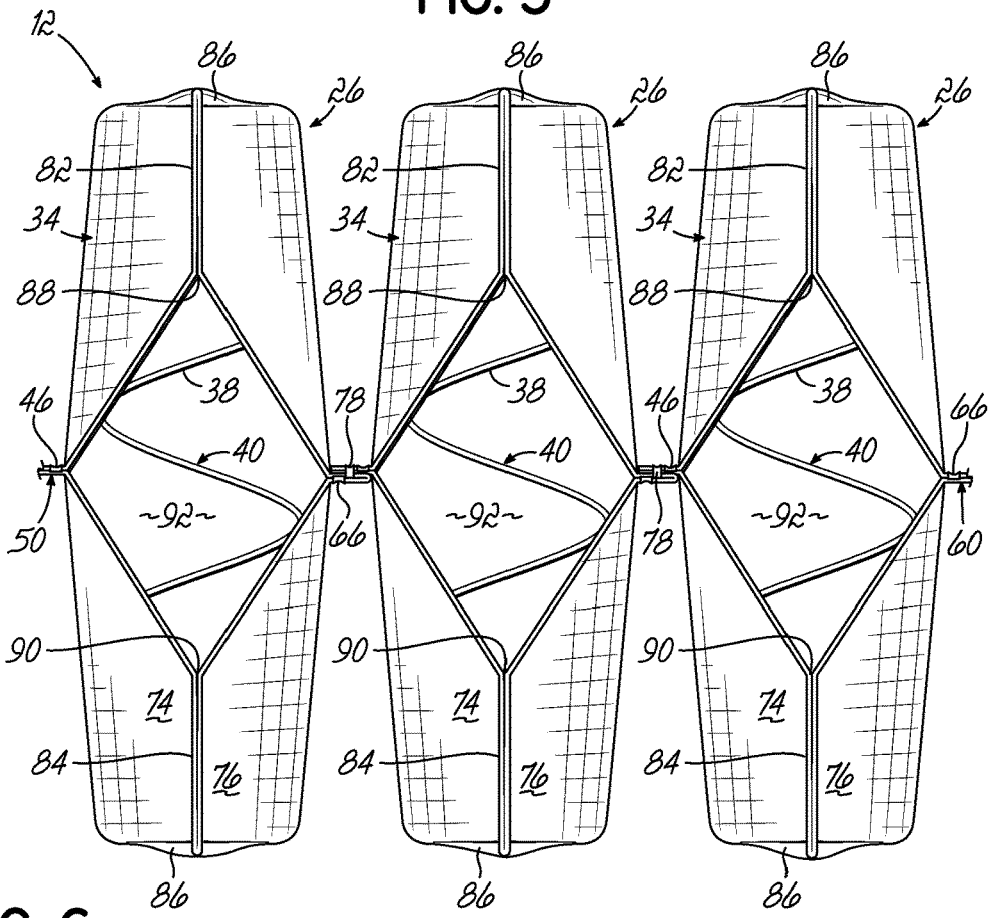
FIG. 6 is an end elevational view of the portion of the pocketed spring assembly of FIG. 3B in a relaxed condition.

As best illustrated in FIGS. 3A and 5, each string 26 comprises a row 40 of coil springs 38 and a sheet of fabric 34 surrounding the coil springs 38. In FIGS. 3A and 3B, each of the rows 40 of coil springs 38 of each string 26 is illustrated extending into the page.

The fabric may be polypropylene fabric, which may be welded to itself. Alternatively, the fabric may not be weldable, in which case the side seams, longitudinal seams joining adjacent strings and the separating seams defining pockets within a string, would be sewn seams, as opposed to weld seams.

FIG. 3A illustrates a cross-sectional view of three strings 26 of pocketed spring assembly 12 before they are joined. FIG. 3B illustrates a cross-sectional view of the strings 26 of FIG. 3A after being joined. The sheet of fabric 34 is passed over an upper portion of a row 40 of coil springs 38 so the sheet of fabric 34 has an inverted trough-shape over each row 40 of coil springs 38.

As shown in FIG. 3A, the sheet of fabric 34 has a first side edge 36 and a first or upper layer 42 of a first tab 50 extending inwardly from the first side edge 36. The sheet of fabric 34 is then folded upwardly to form an inverted trough-shaped portion 48 extending over the tops of coil springs 38 of the row 40. Each inverted trough-shaped portion 48 comprises a rising portion 52 extending in a positively sloped direction, a generally planar top portion 54 and dropping portion 55 extending in a negatively sloped direction.

The sheet of fabric 34 is then folded outward and bent under itself to form a second tab 60 having a first or upper layer 56, a second or lower layer 58 and a rounded edge 62 connecting the first and second layers 56, 58 of second tab 60. The first and second layers 56, 58 of second tab 60 are joined together with a second side seam 66 which extends generally the same direction as the first side seam 46 and row 40 of coil springs 38.

The sheet of fabric 34 continues from the second tab 60, extending downwardly under a lower portion of the row 40 of coil springs 38 so the sheet of fabric 34 has a trough-shaped portion 64 under the row 40 of coil springs 38. As shown in FIG. 3A, the trough-shaped portion 64 of sheet of fabric 34 comprises a dropping portion 68 extending in a negatively sloped direction, a generally planar bottom portion 70, and rising portion 72 extending in a positively sloped direction. As shown in FIGS. 3A and 3B, the sheet of fabric 34 extends outwardly from the end of the rising portion 70 of the trough-shaped portion 64 into a second or lower layer 44 of the first tab 50 and terminates along the other side edge 36 of the sheet of fabric 34. The first and second layers 42, 44 of first tab 50 are joined together with a first side seam 46 which extends generally the same direction as the second side seam 66 and the direction of row 40 of coil springs 38.

As shown in FIGS. 3A and 3B, the first tab 50 extends outwardly from a first ply 74 of the string 26 on one side of the row 40 of coil springs 38. Likewise, the second tab 60 extends outwardly from a second ply 76 of the string 26 on the other side of the row 40 of coil springs 38.

As shown in FIG. 3B, the first tab 50 of one string 26 is joined to the second tab 60 of an adjacent string 26 by a longitudinal seam 78. Although the drawings show a first tab 50 of one string 26 overlapping a second tab 60 of an adjacent string 26, the overlapping tabs 50, 60 being joined by one longitudinal seam 78, more than one longitudinal seam 78 may be used to join overlapping tabs of any adjacent strings shown or described herein. Regardless of whether any of the strings have side seams or not, more than one longitudinal seam may join overlapping tabs of any adjacent strings shown or described herein.

Although FIG. 3B shows the first tab 50 of one string 26 being below the second tab 60 of an adjacent string 26, the reverse could be done. The second tab 60 of one string 26 could be below the first tab 50 of an adjacent string 26 in an overlapping manner. Although the drawings show one longitudinal seam 78 joining overlapped first and second tabs 50, 60 of adjacent strings 26 between the side seams of the overlapped tabs 50, 60, more than one longitudinal seam 78 could be used to join overlapped first and second tabs 50, 60 of adjacent strings 26. The drawings are not intended to limit the location or number of side seams or longitudinal seams.

As best shown in FIGS. 2 and 3B, each string 26 comprises a row 40 of individually pocketed coil springs 38. Each string 26 comprises a plurality of interconnected fabric pockets 80, separated by first and second separating seams 82, 84, respectively. Aligned first and second separating seams 82, 84 separate adjacent pockets 80 and adjacent coil springs 38 therein from each other. At each end of each string 26 of coil springs 38, one first separating seam 82 and an aligned second separating seam 84 keep the outermost coil springs 38 in the string 26.

As best shown in FIG. 5, each first separating seam 82 joins the first ply 74 of sheet of fabric 34 to the second ply 76 of sheet of fabric 34 and extends downwardly from an ear 86 between adjacent pockets 80 to an end 88. Each second separating seam 84 joins the first ply 74 of the sheet of fabric 36 to the second ply 76 of sheet of fabric 34 and extends upwardly from an ear 86 between adjacent pockets 80 to an end 90. Ears 86 are known to those skilled in the art.

As shown in FIG. 5, each first separating seam 82 has a length approximately one-third the height "H" of the pocketed coil spring 38 and pockets 80. As best shown in FIGS. 2 and 3B, the distance between the ends 88, 90 of aligned first and second separating seams 82, 84 defines a gap 92. When fully assembled, the gaps 92 assume a generally diamond-shaped configuration, as shown in FIGS. 2 and 3B, which allow air to flow through the pockets 80 and through the strings 26, thereby cooling any of the pocketed spring assemblies shown or described herein. This is true for any of the strings shown or described herein, including strings 26*a* and 26'.

Each of the fabric pockets 80 contains at least one coil spring 38. The coil spring 38 is preferably made of one piece of wire of a uniform diameter, but may be made of other materials, multiple strands of twisted wire and/or may be a non-uniform diameter. Although the drawings show one version of coil spring 38, any known coil springs may be used in accordance with the present invention. The coil springs 38 are preferably six to eight inches tall. In one embodiment, each of the coil springs 38 of each of the rows 40 of each of the strings is the same height. However, the coil springs 38 of some of the rows 40 of some of the strings may be a different height than other coil springs 38 of other rows 40 of other strings.

Although the seams or welds in the embodiments shown herein are shown as being heat-welded spaced rectangles, any of the seams may be spaced dots, triangles or solid line segments without spaces.

Figure 7:
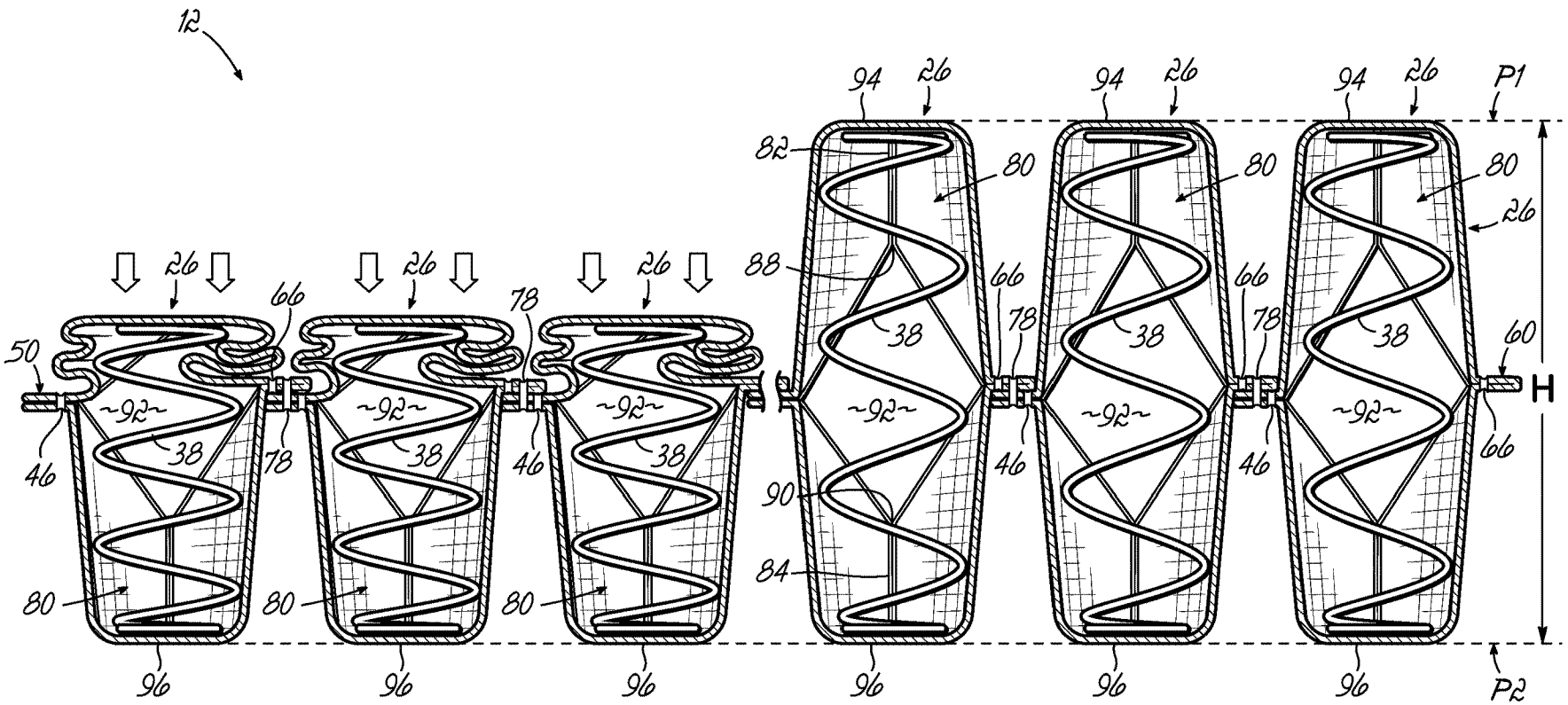
FIG. 7 is a side elevational view of a portion of the pocketed spring assembly of FIG. 1 in an unloaded condition and another portion in a loaded condition.

FIG. 7 illustrates a cross-sectional view of a portion of a pocketed spring assembly 12 showing six strings 26, three outer strings on one side being compressed and three outer strings on the other side being expanded or in a relaxed condition. As shown in FIG. 7, the strings 26 have a generally planar top surface 94 in a top plane P1 and a parallel generally planar bottom surface 96 in a bottom plane P2. The linear distance between the top and bottom surfaces 94, 96 of the strings 26 defines a height H of the strings 26. This linear distance further defines the height H of the pocketed spring assembly 12 because each of the strings 26 has the same height. However, it is within the scope of the present invention that different strings of a pocketed spring assembly have different heights. Along each of the sides of the pocketed spring assembly 12, no longitudinal seams 78 extend parallel the strings 26. This feature results from the manufacturing process in which, along the outermost sides of the pocketed spring assembly, the outermost tab of the outermost string does not overlap with another tab of another string.

Figure 7A:
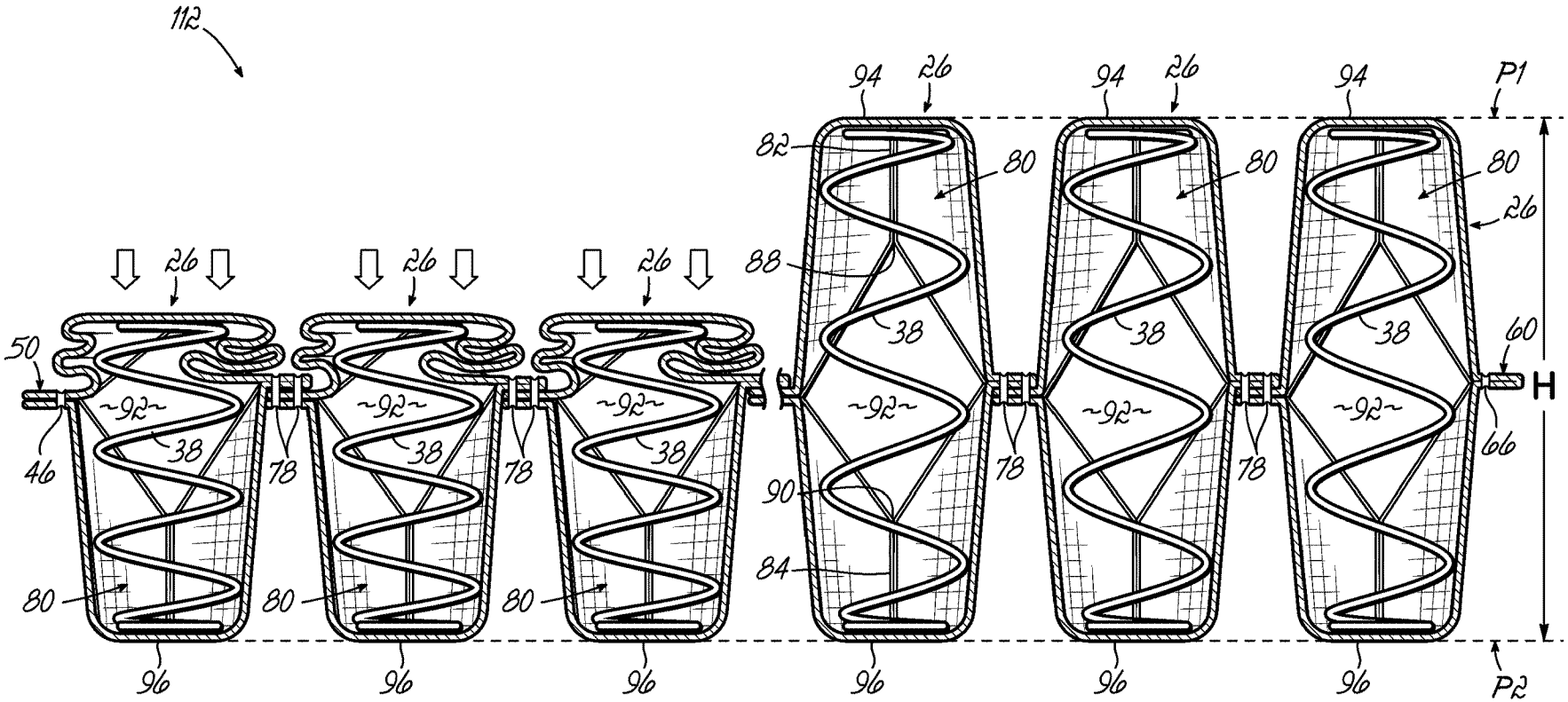
FIG. 7A is a cross-sectional view, like FIG. 7, of a portion of another embodiment of pocketed spring assembly, a portion of the pocketed spring assembly being in an unloaded condition and another portion being in a loaded condition.

FIG. 7A illustrates a cross-sectional view of a portion of another pocketed spring assembly 112 showing six strings 26, three outer strings on one side being compressed and three outer strings on the other side being expanded or in a relaxed condition. Unlike the pocketed spring assembly 12 shown and described herein which has only one longitudinal seam 78 joining overlapping tabs 50, 60 of adjacent strings 26, extends between adjacent strings 26, pocketed spring assembly 112 shown in FIG. 7A, has two longitudinal seams 78 joining overlapping tabs 50, 60 of adjacent strings 26. The separating seams 82, 84 of pocketed spring assembly 112 are the same as the other pocketed spring assemblies shown and described herein. This concept of joining overlapping tabs 50, 60 of adjacent strings 26 with multiple (two or more) longitudinal seams 78 may be used in any pocketed spring assembly shown or described herein using any strings shown or described herein.

Figure 7B:
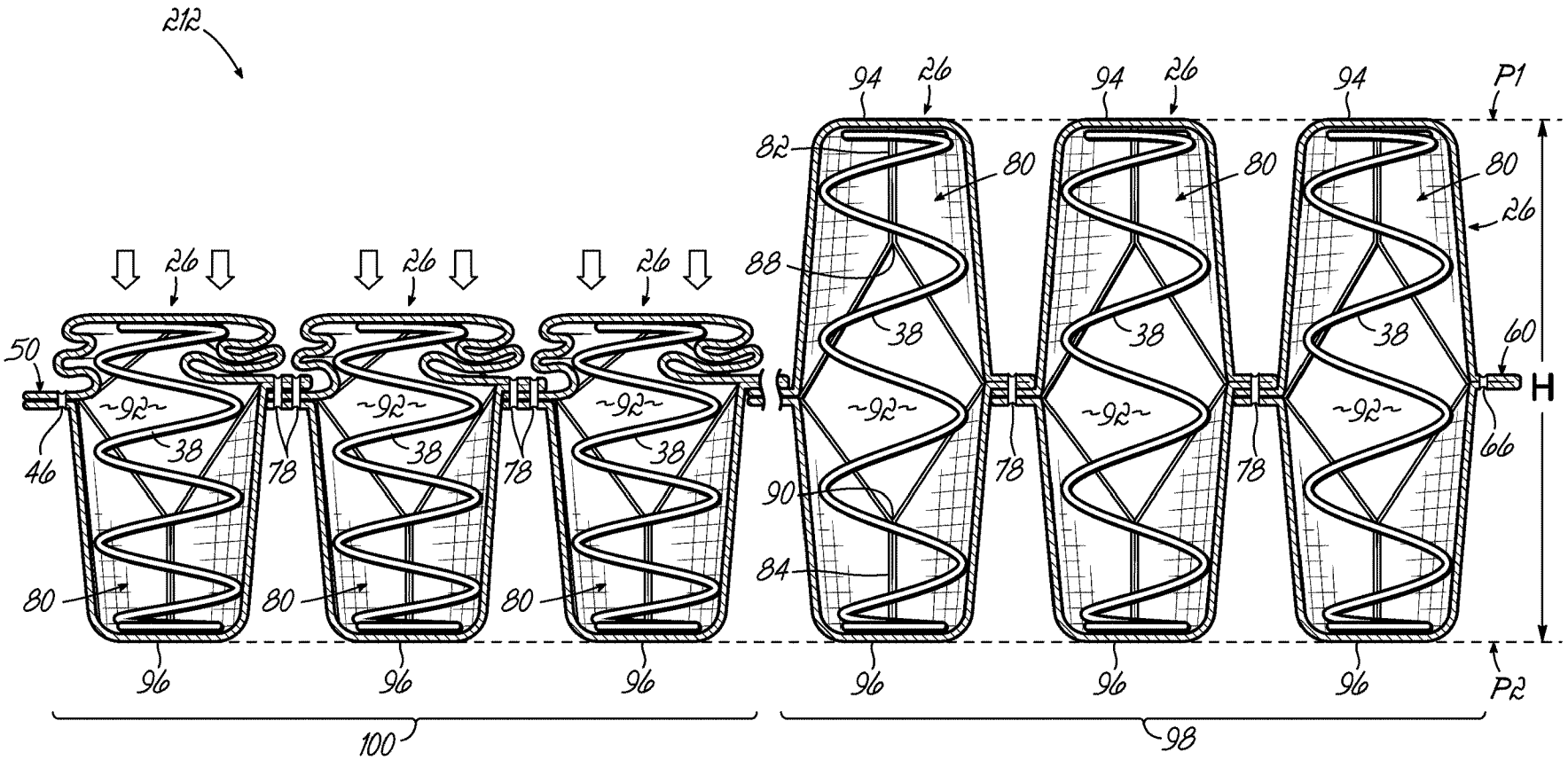
FIG. 7B is a cross-sectional view, like FIG. 7, of a portion of another embodiment of pocketed spring assembly, a portion of the pocketed spring assembly being in an unloaded condition and another portion being in a loaded condition.

FIG. 7B illustrates a cross-sectional view of a portion of a posturized pocketed spring assembly 212 showing six strings 26, three outer strings on one side being compressed and three outer strings on the other side being expanded or in a relaxed condition. In posturized pocketed spring assembly 212, half of the posturized pocketed spring assembly 212, region 98 is firmer than region 100 because region 98 has more strings 26 of pocketed springs. Region 98 may have more strings 26 than region 100 because adjacent strings 26 within firmer region 98 are separated by single longitudinal seams 78. On the other hand, adjacent strings 26 within softer region 98 are separated by double longitudinal seams 78 spaced from each other. By changing the number of longitudinal seams 78 and the distance between them, the spring density of one region may be greater than the spring density of another region. By changing the distance and number of longitudinal seams 78, any pocketed spring assembly shown or described herein may be posturized to have any number of regions of different firmness, regardless of the direction of the strings of pocketed springs.

The construction of the pocketed spring assemblies shown and described herein made from strings of springs each having opposed tabs, the tabs being joined by any number of longitudinal seams provides greater independence to the strings than prior art pocketed spring assemblies in which glue beads join adjacent strings of springs. Therefore, loads on select strings affect adjacent strings less than prior art pocketed spring assemblies in which strings of springs are glued together. Such string independence results in less motion transfer, an advantage of the unique pocketed spring assemblies shown and described herein.

FIGS. 3AA and 3BB illustrate cross-sectional views of a portion of another embodiment of pocketed spring assembly 312. For simplicity, like numbers represent like parts. As shown in FIG. 3AA, a piece of fabric 34' comprising at least two layers laminated together may be used in place of sheet of fabric 34 to make a string 26. Piece of fabric 34' may be made of multiple layers joined together, such as the fabric disclosed in U.S. patent application Ser. Nos. 15/062,595 and 15/584,402, for example. Although FIGS. 3AA and 3BB illustrate piece 34' comprising three layers joined together, any number of layers may be joined together to create piece 34'. In some applications, one string may be made with a single sheet of fabric, while another string may be made with a piece of fabric comprising multiple layers joined together in any known manner, such as via lamination.

Figure 8A:
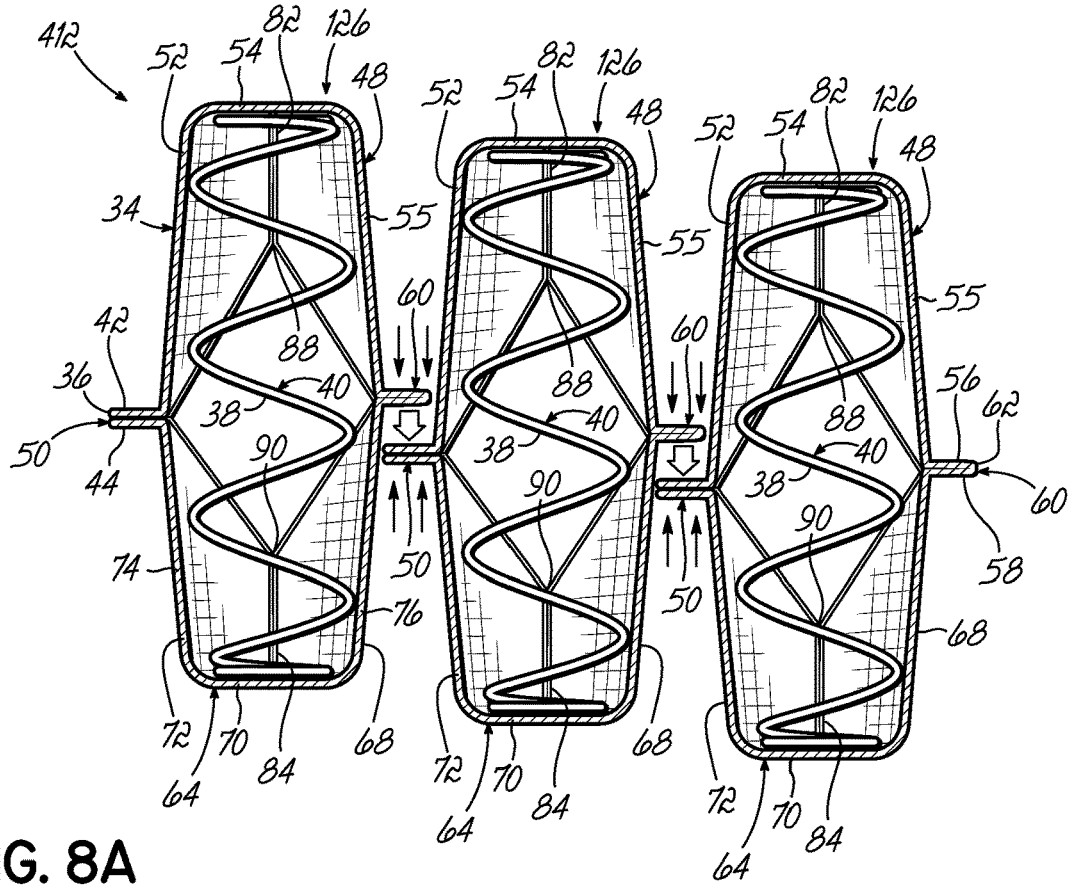
FIG. 8A is a cross-sectional view of a portion of another embodiment of pocketed spring assembly being assembled.

FIGS. 8A-12B illustrate another version of pocketed spring assembly 412 made with parallel strings 126 joined with longitudinal seams 78. FIG. 8A illustrates a cross-sectional view of three strings 126 of pocketed spring assembly 412 before they are joined. FIG. 8B illustrates a cross-sectional view of the strings 126 of FIG. 8A after being joined. Each string 126 is made with one piece of material the same as each string 26. Each string 126 is identical to string 26, but without the side seams. For simplicity, like parts are given the same number. The sheet of fabric 34 is passed over an upper portion of a row 40 of coil springs 38 so the sheet of fabric 34 has an inverted trough-shape over each row 40 of coil springs 38.

As shown in FIG. 8A, the sheet of fabric 34 has a first side edge 36 and a first or upper layer 42 of a first tab 50 extending inwardly from the first side edge 36. The sheet of fabric 34 is then folded upwardly to form an inverted trough-shaped portion 48 extending over the tops of coil springs 38 of the row 40 of coil springs 38. Each inverted trough shaped portion 48 comprises a rising portion 52 extending in a positively sloped direction, a generally planar top portion 54 and dropping portion 55 extending in a negatively sloped direction.

The sheet of fabric 34 is then folded outward and bent under itself to form a second tab 60 having a first or upper layer 56, a second or lower layer 58 and a rounded edge 62 connecting the first and second layers 56, 58 of second tab 60. The second tab 60 extends generally the same direction as the row 40 of coil springs 38.

Figure 8B:
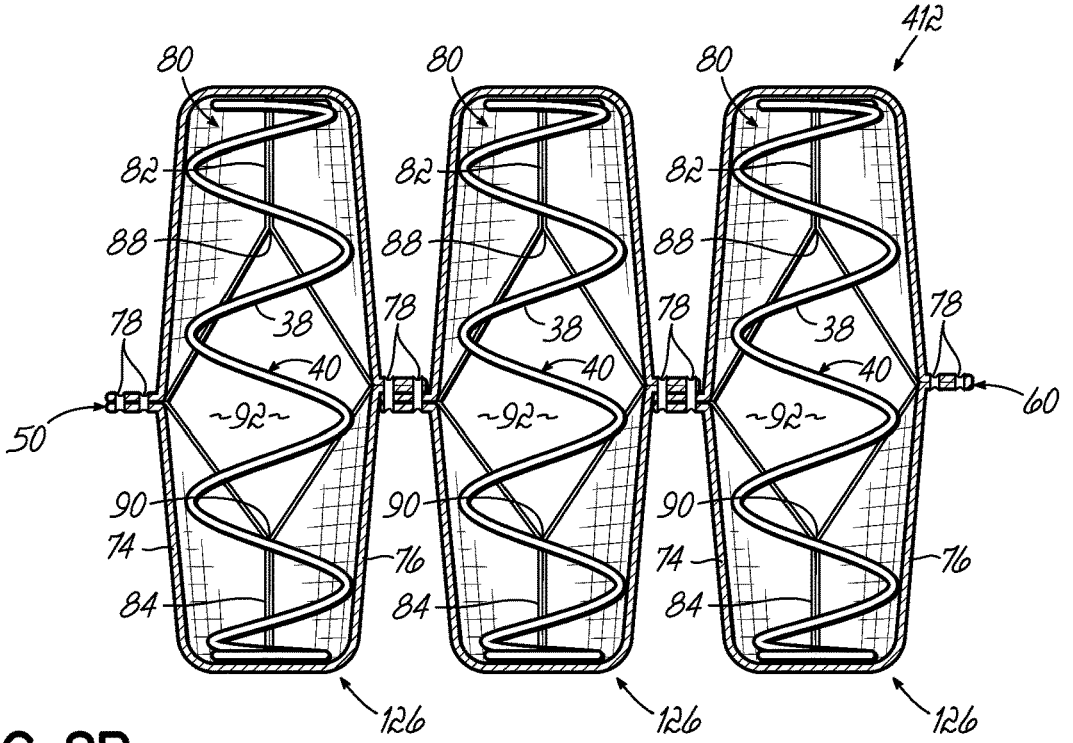
FIG. 8B is a cross-sectional view of the portion of the pocketed spring assembly of FIG. 8A assembled.
Figure 8A:
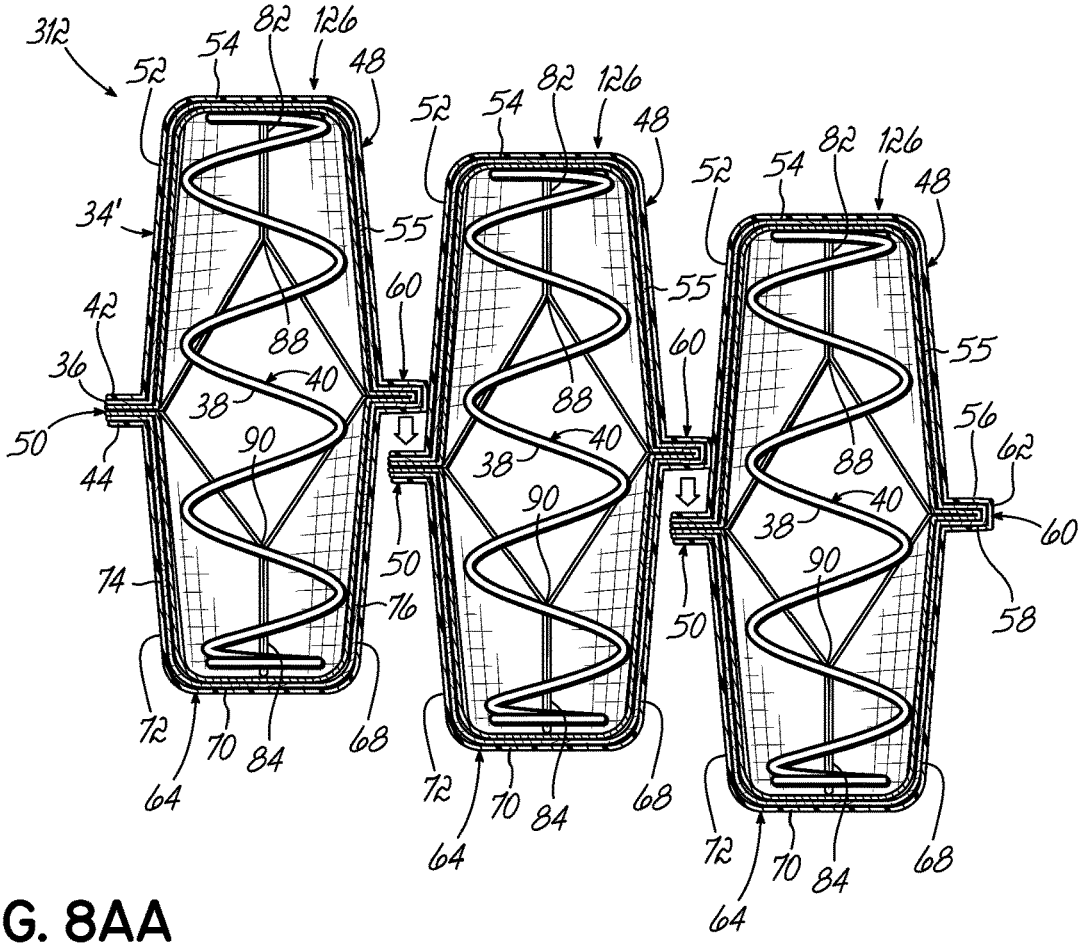
Figure 8B:
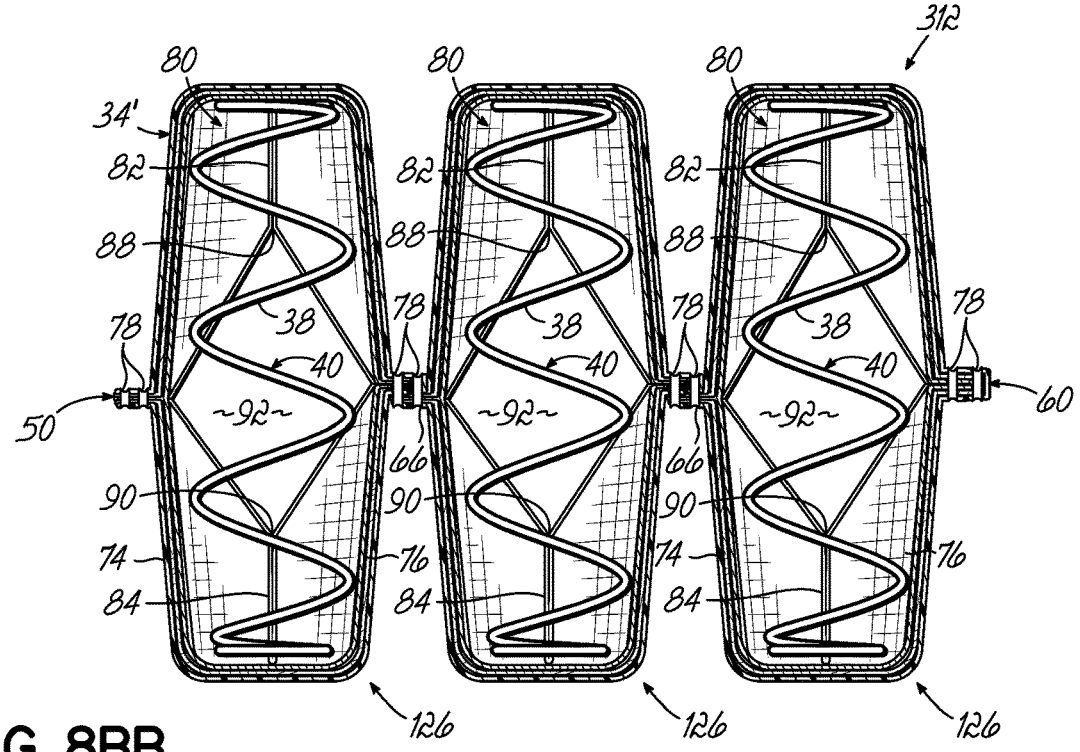

The sheet of fabric 34 continues from the second tab 60, extending downwardly under a lower portion of the row 40 of coil springs 38 so the sheet of fabric 34 has a trough-shaped portion 64 under the row 40 of coil springs 38. As shown in FIG. 8A, the trough-shaped portion 64 of sheet of fabric 34 comprises a dropping portion 68 extending in a negatively sloped direction, a generally planar bottom portion 70, and rising portion 72 extending in a positively sloped direction. As shown in FIGS. 8A and 8B, the sheet of fabric 34 extends outwardly from the end of the rising portion 70 of the trough-shaped portion 64 into a second or lower layer 44 of the first tab 50 and terminates along the other side edge 36 of the sheet of fabric 34. The first tab 50 extends generally the same direction as the second tab 60 and the direction of row 40 of coil springs 38.

As shown in FIGS. 8A and 8B, the first tab 50 extends outwardly from a first ply 74 of the string 126 on one side of the row 40 of coil springs 38. Likewise, the second tab 60 extends outwardly from a second ply 76 of the string 126 on the other side of the row 40 of coil springs 38.

As shown in FIG. 8B, the first tab 50 of one string 126 is joined to the second tab 60 of an adjacent string 126 by two longitudinal seams 78. Although the drawings show a first tab 50 of one string 126 overlapping a second tab 60 of an adjacent string 126, the overlapping tabs 50, 60 being joined by two spaced longitudinal seams 78, any number of longitudinal seams 78 including only one may be used to join overlapping tabs of any adjacent strings shown or described herein. Regardless of whether any of the strings have side seams or not, a single longitudinal seam may join overlapping tabs of any adjacent strings shown or described herein.

Although FIG. 8B shows the first tab 50 of one string 126 being below the second tab 60 of an adjacent string 126, the reverse could be done. The second tab 60 of one string 126 could be below the first tab 50 of an adjacent string 126 in an overlapping manner. Although the drawings show two longitudinal seams 78 joining overlapped first and second tabs 50, 60 of adjacent strings 126, any number of longitudinal seams could be used to join overlapped first and second tabs 50, 60 of adjacent strings 126. The drawings are not intended to limit the location or number of longitudinal seams.

As best shown in FIG. 8B, each string 126 comprises a row 40 of individually pocketed coil springs 38. Each string 126 comprises a plurality of interconnected fabric pockets 80, separated by first and second separating seams 82, 84, respectively. Aligned first and second separating seams 82, 84 separate adjacent pockets 80 and adjacent coil springs 38 therein from each other. At each end of each string 126 of coil springs 38, one first separating seam 82 and an aligned second separating seam 84 keep the outermost coil springs 38 in the string 126.

Figure 9:
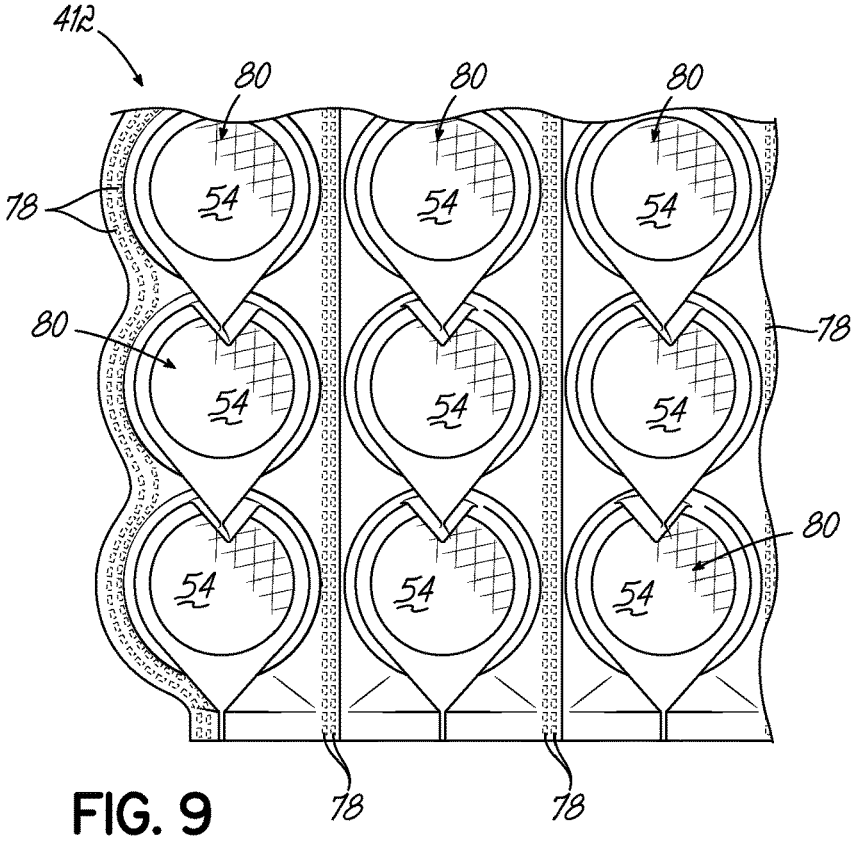
FIG. 9 is a top view of a portion of the pocketed spring assembly of FIG. 8A in a relaxed condition.
Figure 9A:
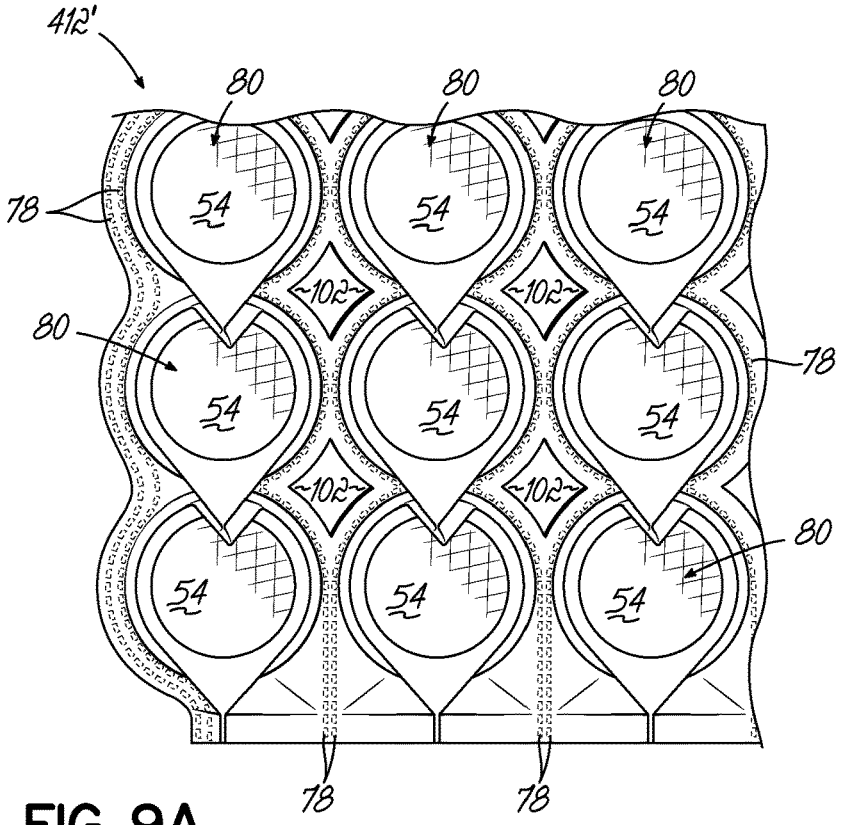
FIG. 9A is a top view of a portion of another version of pocketed spring assembly in a relaxed condition.

As shown in FIG. 9A, between adjacent spaced longitudinal seams 78 between adjacent strings 126, during the manufacturing process, an interstitial slit may be made through the overlapping first and second tabs 50, 60 between fabric pockets 80. When the pocketed spring assembly 412' expands, each interstitial slit becomes a diamond-shaped opening 102. Furthermore, each of the longitudinal seams 60 between adjacent strings 126 assumes a non-linear pattern as shown in FIG. 9A. Each of the longitudinal seams 78 has curved portions extending along the sides of the pockets 80. The slits made during the manufacturing process, which become diamond-shaped openings 102, enable each of the longitudinal seams 78 to conform to the shapes of the full pockets 80 along the lengths of the longitudinal seams 78. The slits (not shown) allow the fabric to wrap around the springs 38 in an aesthetically pleasing manner. The pocketed spring assembly, with the openings 102 between adjacent longitudinal seams 78, improves the appearance of the pocketed spring assembly.

Figure 10:
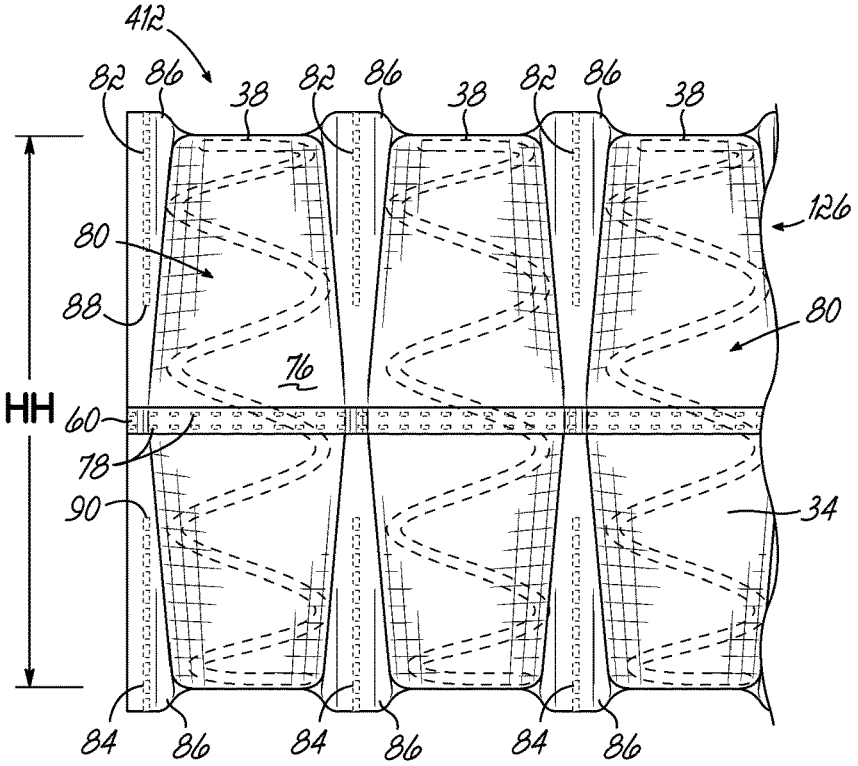
FIG. 10 is a side elevational view of the portion of a string of the pocketed spring assembly of FIG. 8A in a relaxed condition.

As best shown in FIG. 10, each first separating seam 82 joins the first ply 74 of sheet of fabric 34 to the second ply 76 of sheet of fabric 34 and extends downwardly from an ear 86 between adjacent pockets 80 to an end 88. Each second separating seam 84 joins the first ply 74 of the sheet of fabric 36 to the second ply 76 of sheet of fabric 34 and extends upwardly from an ear 86 between adjacent pockets 80 to an end 90. Ears 86 are known to those skilled in the art.

Figure 11:
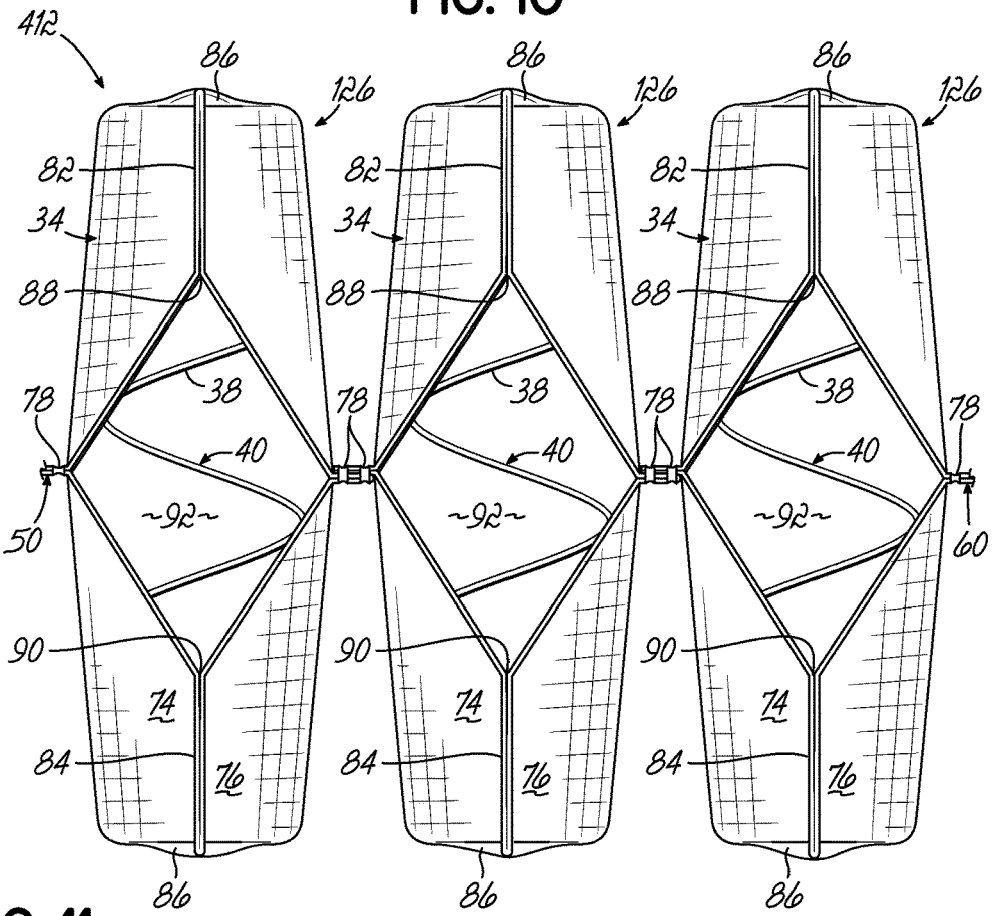
FIG. 11 is an end elevational view of the portion of the pocketed spring assembly of FIG. 8B in a relaxed condition.

As shown in FIG. 10, each first separating seam 82 has a length approximately one-third the height "HH" of the pocketed coil spring 38 and pockets 80. As best shown in FIG. 8B, the distance between the ends 88, 90 of aligned first and second separating seams 82, 84 defines a gap 92. When fully assembled, the gaps 92 assume a diamond-shaped configuration, as shown in FIGS. 8B and 11, which allow air to flow through the pockets 80 and through the strings 126 of pocketed springs 38, thereby cooling any of the pocketed spring assemblies shown or described herein. This is true for any of the strings shown or described herein, including strings 26*a* and 26'.

Each of the fabric pockets 80 contains at least one coil spring 38. The coil spring 38 is preferably made of one piece of wire of a uniform diameter, but may be made of other materials, multiple strands of twisted wire and/or may be a non-uniform diameter. Although the seams or welds in the embodiments shown herein are shown as being heat-welded spaced rectangles, any of the seams may be spaced dots, triangles or solid line segments without spaces.

Figure 12:
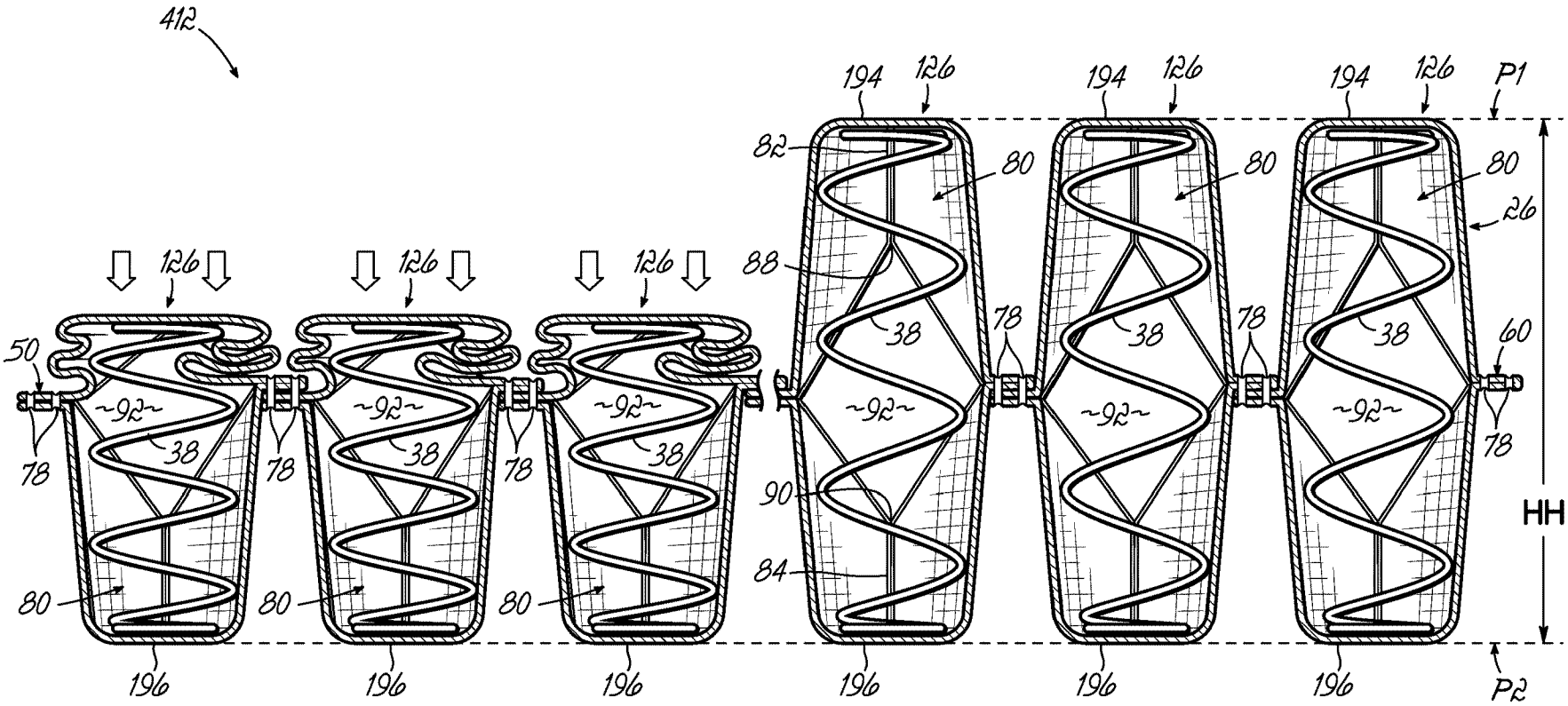
FIG. 12 is a cross-sectional view of a portion of the pocketed spring assembly of FIG. 8A in an unloaded condition and another portion in a loaded condition.

FIG. 12 illustrates a cross-sectional view of a portion of a pocketed spring assembly 412 showing six strings 126, three outer strings on one side being compressed and three outer strings on the other side being expanded or in a relaxed condition. As shown in FIG. 12, in a relaxed or unloaded condition, each of the strings 126 has a generally planar top surface 194 in a top plane P1 and a parallel generally planar bottom surface 196 in a bottom plane P2. The linear distance between the top and bottom surfaces 194, 196 of the strings 26 defines a height HH of the strings 126. This linear distance further defines the height HH of the pocketed spring assembly 412 because each of the strings 126 has the same height. However, it is within the scope of the present invention that different strings of a pocketed spring assembly have different heights. Along each of the sides of the pocketed spring assembly 412, two longitudinal seams 78 extend parallel the strings 126. This feature results from the manufacturing process in which, along the outermost sides of the pocketed spring assembly 412, longitudinal seams 78 extend only through one of the tabs. See FIG. 8B.

Figure 12A:
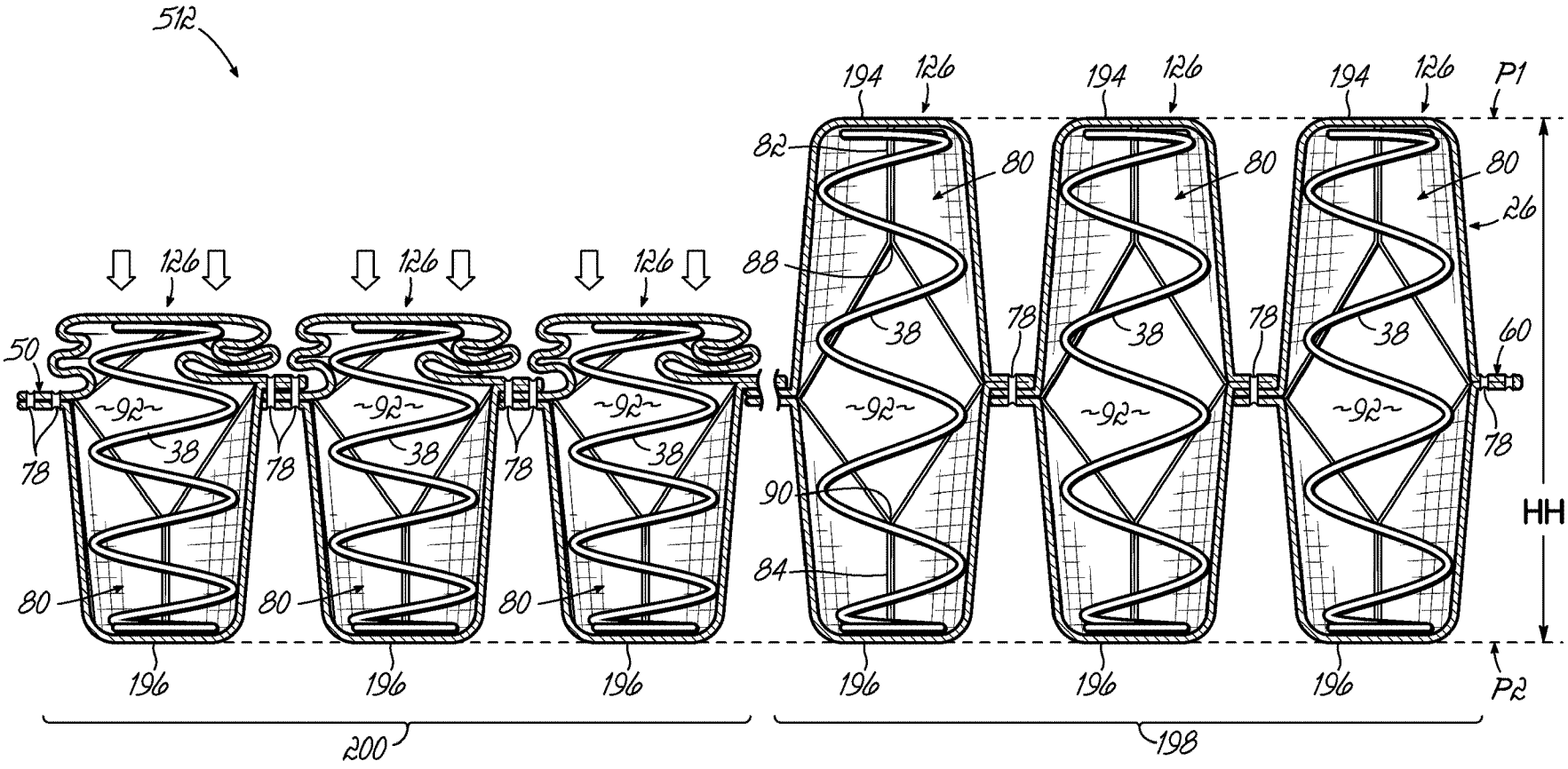
FIG. 12A is a cross-sectional view, like FIG. 12, of a portion of another embodiment of pocketed spring assembly, a portion of the pocketed spring assembly being in an unloaded condition and another portion being in a loaded condition.

FIG. 12A illustrates a cross-sectional view of a portion of a posturized pocketed spring assembly 512 showing six strings 126, three outer strings on one side being compressed and three outer strings on the other side being expanded or in a relaxed condition. In posturized pocketed spring assembly 512, half of the posturized pocketed spring assembly 512, region 198 is firmer than region 200 because region 198 has more strings 126 of pocketed springs. Region 198 may have more strings 126 than region 200 because adjacent strings 126 within firmer region 198 are separated by single longitudinal seams 78. On the other hand, adjacent strings 126 within softer region 198 are separated by double longitudinal seams 78 spaced from each other. By changing the number of longitudinal seams 78 and the distance between them, the spring density of one region may be greater than the spring density of another region. By changing the distance and number of longitudinal seams 78, any pocketed spring assembly shown or described herein may be posturized to have any number of regions of different firmness, regardless of the direction of the strings of pocketed springs.

The construction of the pocketed spring assemblies shown and described herein made from strings of springs each having opposed tabs, the tabs being joined by any number of longitudinal seams provides greater independence to the strings than prior art pocketed spring assemblies in which glue beads join adjacent strings of springs. Therefore, loads on select strings affect adjacent strings less than prior art pocketed spring assemblies in which strings of springs are glued together. Such string independence results in less motion transfer, an advantage of the unique pocketed spring assemblies shown and described herein.

FIGS. 8AA and 8BB illustrate cross-sectional views of a portion of another embodiment of pocketed spring assembly 312. For simplicity, like numbers represent like parts. As shown in FIG. 8AA, a piece of fabric 34' comprising at least two layers laminated together may be used in place of sheet of fabric 34 to make a string 126. Piece of fabric 34' may be made of multiple layers joined together, such as the fabric disclosed in U.S. patent application Ser. Nos. 15/062,595 and 15/584,402, for example. Although FIGS. 8AA and 8BB illustrate piece 34' comprising three layers joined together, any number of layers may be joined together to create piece 34'. In some applications, one string may be made with a single sheet of fabric, while another string may be made with a piece of fabric comprising multiple layers joined together in any known manner, such as via lamination.

Figure 13A:
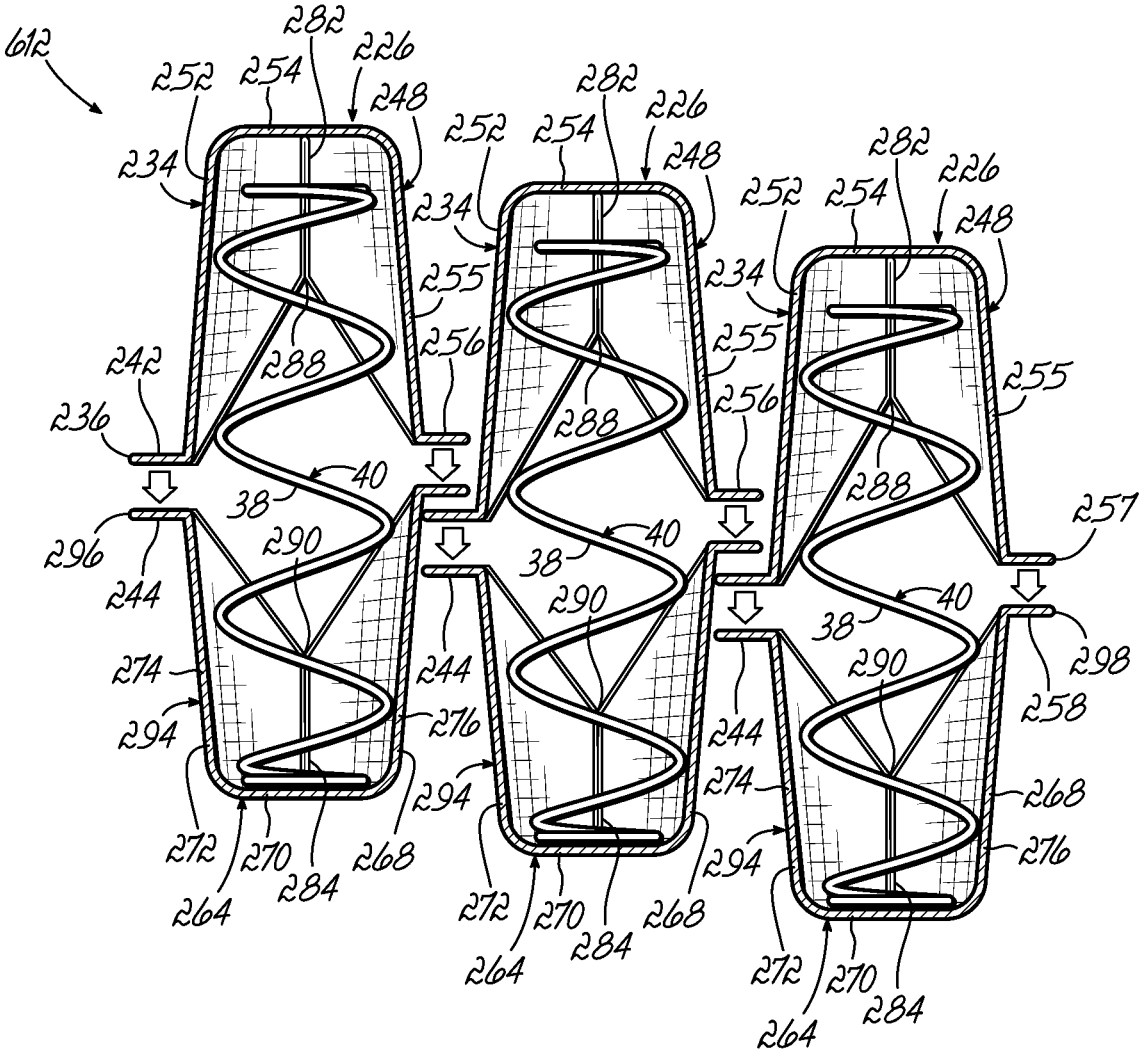
FIG. 13A is a side elevational view of a portion of another embodiment of pocketed spring assembly being assembled.

FIGS. 13A-15 illustrate another version of pocketed spring assembly 612 made with parallel strings 226 joined with longitudinal seams 78. FIG. 13A illustrates a cross-sectional view of three strings 226 of a pocketed spring assembly 612 before the strings 226 are closed and fully formed. FIG. 13B illustrates a cross-sectional view of fully formed strings 226 before adjacent strings 226 are joined. FIG. 13C illustrates a cross-sectional view of the strings 226 of FIG. 13B after adjacent strings are joined.

As shown in FIG. 13A, each of the strings 226 comprises a first sheet of fabric 234 and a second sheet of fabric 294 joined together with first and second side seams 246, 266. The first sheet of fabric 234 has a first side edge 236 and an opposed second side edge 257 and has a length identical to the length of the string 226.

The first sheet of fabric 234 is passed over an upper portion of a row 40 of coil springs 38 so the first sheet of fabric 234 has an inverted trough-shape over the row 40 of coil springs 38. The first sheet of fabric 234 has a first or upper layer 242 of a first tab 250 (shown in FIGS. 13B and 13C) extending inwardly from the first side edge 236. The inverted trough-shaped portion 248 of the first sheet of fabric 234 comprises a rising portion 252 extending in a positively sloped direction, a generally planar top portion 254 and dropping portion 255 extending in a negatively sloped direction. At the bottom of the dropping portion 255, the first sheet of fabric 234 is bent outward to form a first or upper layer 256 of a second tab 260 (shown in FIGS. 13B and 13C). The first or upper layer 256 of the second tab 260 terminates in the second side edge 257 of the first sheet of fabric 234.

The second sheet of fabric 294 has a first side edge 296 and an opposed second side edge 298 and has a length identical to the length of the string 226. The second sheet of fabric 294 is folded inward from its first side edge 296 to form a second or lower layer 244 of the first tab 250. The second sheet of fabric 294 extends downwardly from the second or lower layer 244 of the first tab 250 under a lower portion of the row 40 of coil springs 38 to form a trough-shaped portion 264 under the row 40 of coil springs 38. As shown in FIG. 13A, the trough-shaped portion 264 of second sheet of fabric 294 comprises a dropping portion 272 extending in a negatively sloped direction, a generally planar bottom portion 270, and rising portion 268 extending in a positively sloped direction. As shown in FIG. 13A, the second sheet of fabric 294 extends outwardly from the end of the rising portion 268 of the trough-shaped portion 264 into a second or lower layer 258 of the second tab 260 and terminates along the second side edge 298 of the second sheet of fabric 294.

Figure 13B:
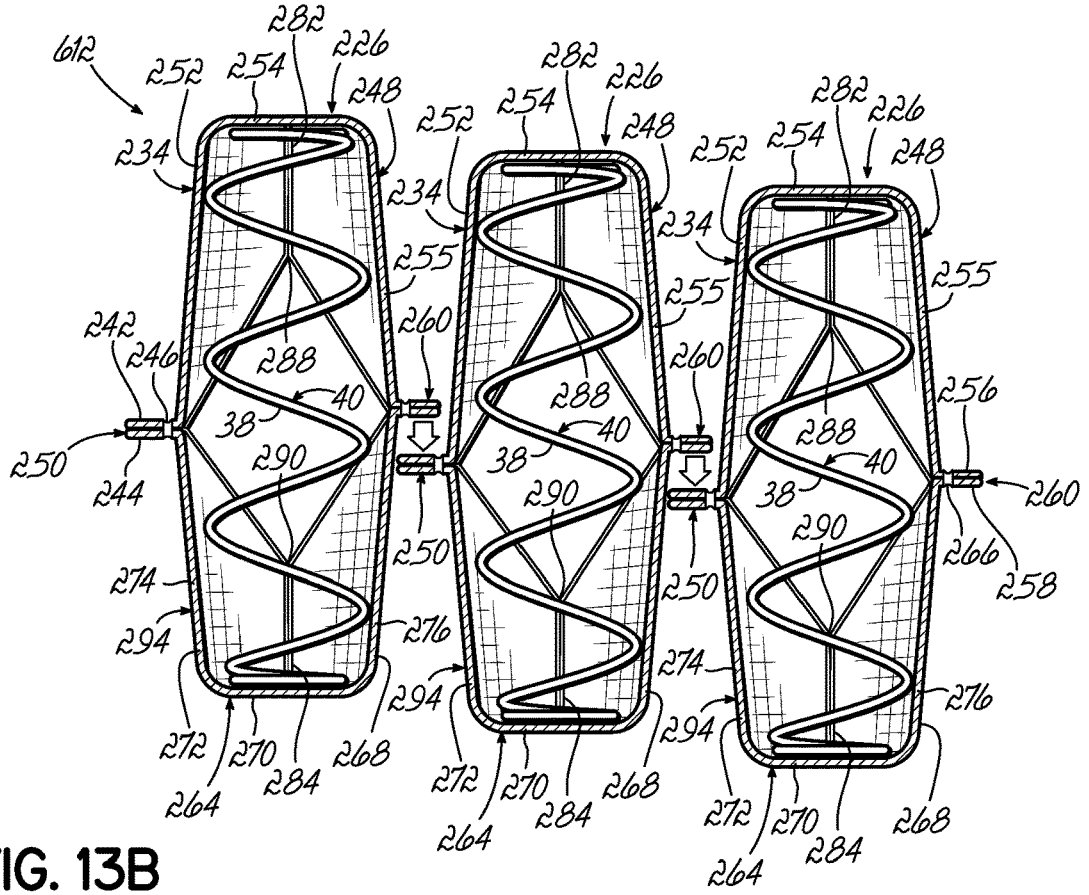
FIG. 13B is a cross-sectional view of the portion of the pocketed spring assembly of FIG. 13A being further assembled.

As shown in FIG. 13B, the first and second layers 242, 244 of first tab 250 are joined with a first side seam 246 which extends generally the same direction as the direction of row 40 of coil springs 38. Similarly, the first and second layers 256, 258 of second tab 260 are joined together with a second side seam 266 which extends generally the same direction as the first side seam 246 and row 40 of coil springs 38.

As shown in FIGS. 13A and 13B, the first tab 250 extends outwardly from a first ply 274 of the string 226 on one side of the row 40 of coil springs 38. Likewise, the second tab 260 extends outwardly from a second ply 276 of the string 226 on the other side of the row 40 of coil springs 38.

Figure 13C:
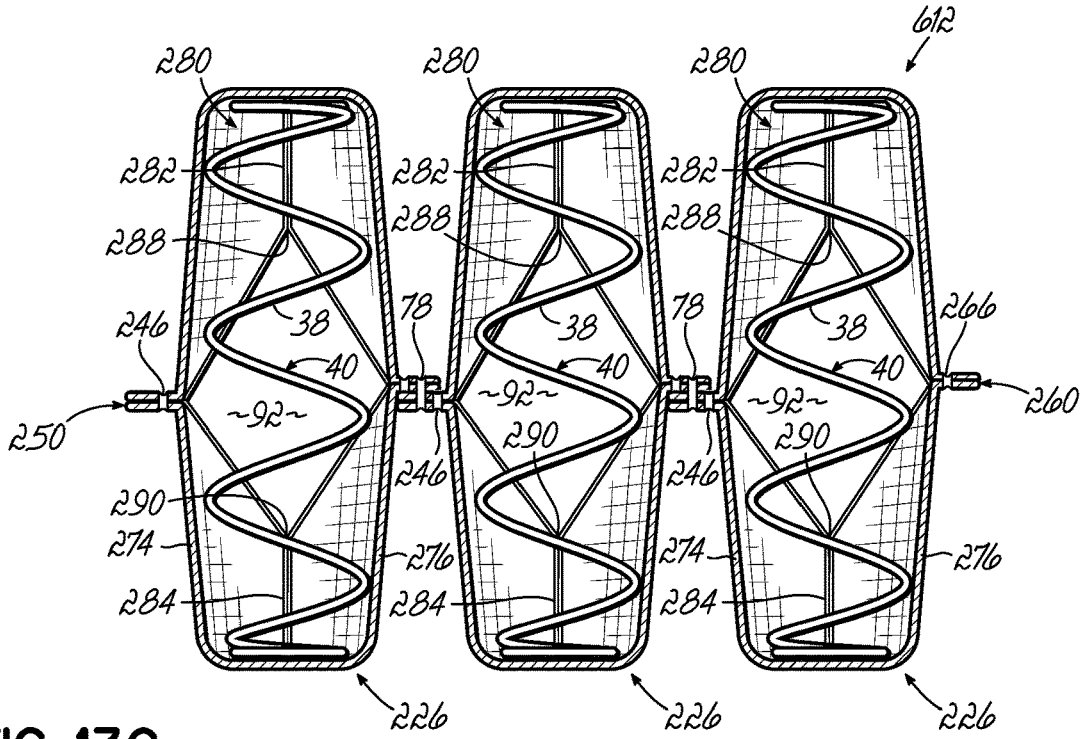
FIG. 13C is a cross-sectional view of the portion of the pocketed spring assembly of FIG. 13A being assembled.

As shown in FIG. 13C, the first tab 250 of one string 226 is joined to the second tab 260 of an adjacent string 226 by a longitudinal seam 78. Although the drawings show a first tab 250 of one string 226 overlapping a second tab 260 of an adjacent string 226, the overlapping tabs 250, 260 being joined by one longitudinal seam 78, more than one longitudinal seam 78 may be used to join overlapping tabs of any adjacent strings shown or described herein. Regardless of whether any of the strings have side seams or not, more than one longitudinal seam may join overlapping tabs of any adjacent strings shown or described herein.

Although FIG. 13C shows the first tab 250 of one string 226 being below the second tab 260 of an adjacent string 226, the reverse could be done. The second tab 260 of one string 226 could be below the first tab 250 of an adjacent string 226 in an overlapping manner. Although the drawings show one longitudinal seam 78 joining overlapped first and second tabs 250, 260 of adjacent strings 226 between the side seams of the overlapped tabs 250, 260, more than one longitudinal seam 78 could be used to join overlapped first and second tabs 250, 260 of adjacent strings 226. The drawings are not intended to limit the location or number of side seams or longitudinal seams.

Figure 14:
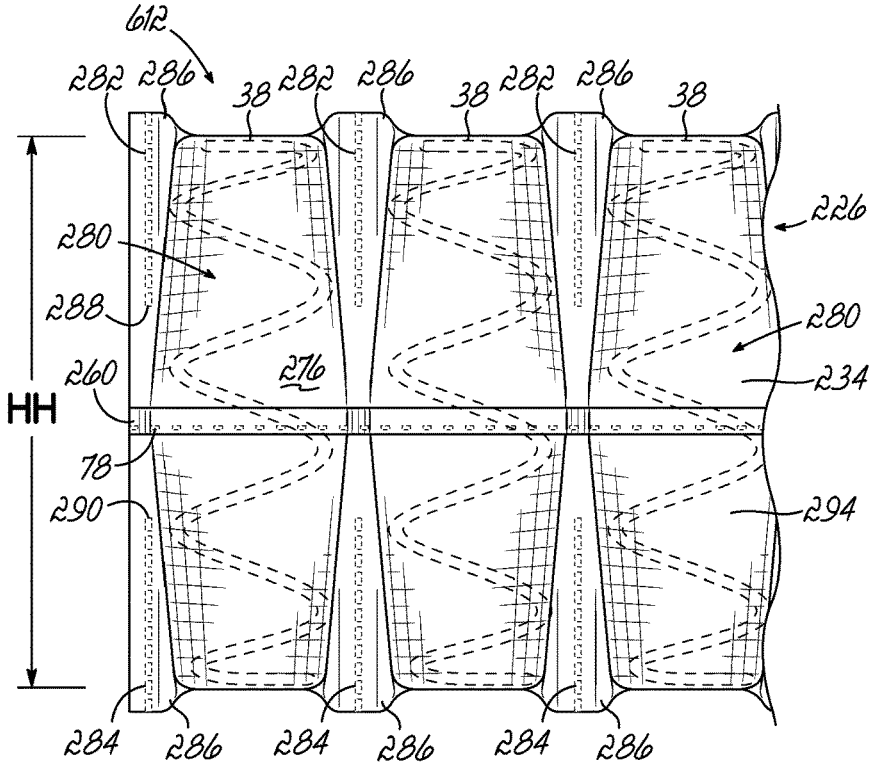
FIG. 14 is a side elevational view of the portion of a string of the pocketed spring assembly of FIG. 13B in a relaxed condition.
Figure 15:
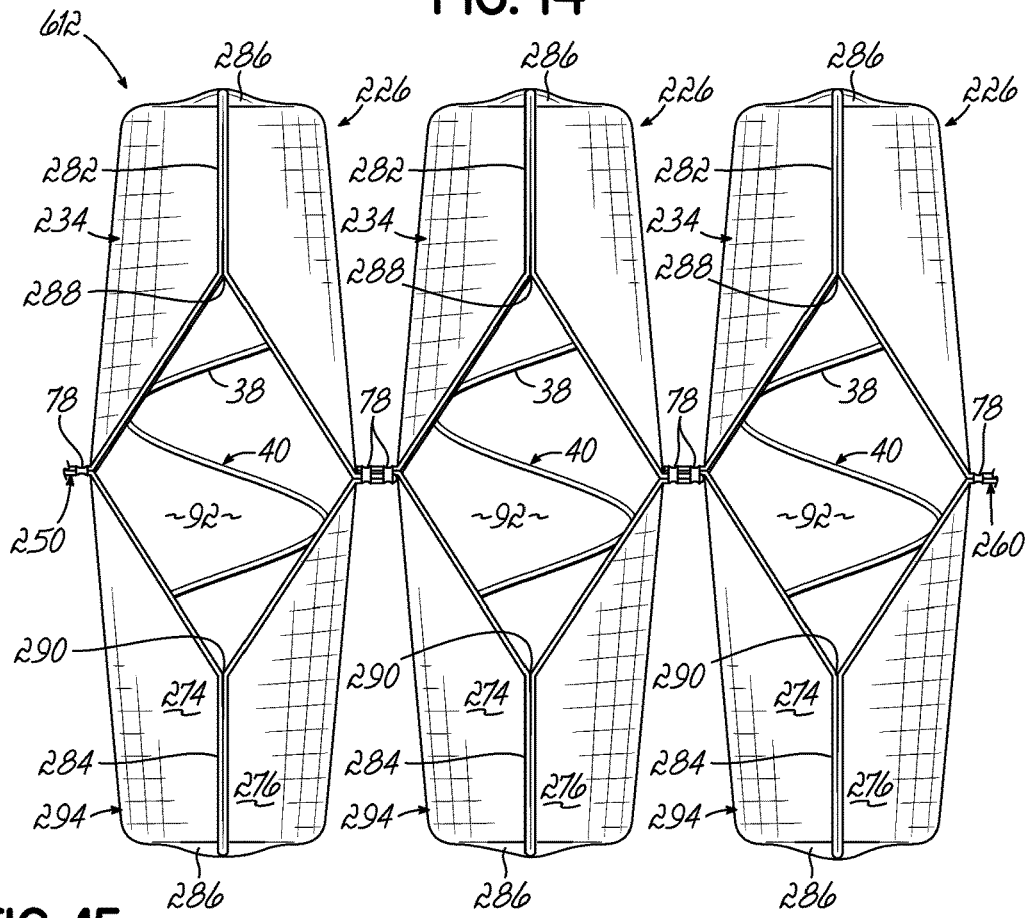
FIG. 15 is an end elevational view of the portion of the pocketed spring assembly of FIG. 13C in a relaxed condition.

As best shown in FIGS. 13A, 13B, 13C and 15, each string 226 comprises a row 40 of individually pocketed coil springs 38. As best shown in FIGS. 14 and 15, each string 226 comprises a plurality of interconnected fabric pockets 280, separated by first and second separating seams 282, 284, respectively. Aligned first and second separating seams 282, 284 separate adjacent pockets 280 and adjacent coil springs 38 therein from each other. At each end of each string 226 of coil springs 38, one first separating seam 282 and an aligned second separating seam 284 keep the outermost coil springs 38 in the string 226.

Each first separating seam 282 joins the first sheet of fabric 234 to itself and extends downwardly from an ear 286 between adjacent pockets 280 to an end 288. More specifically, each first separating seam 282 joins the first ply 274 of string 226 to the second ply 276 of the string 226.

Each second separating seam 284 joins the second sheet of fabric 294 to itself and extends upwardly from an ear 286 between adjacent pockets 280 to an end 290. More specifically, each second separating seam 284 joins the first ply 274 of string 226 to the second ply 276 of the string 226. Ears 286 are known to those skilled in the art.

Although not shown, either the first sheet of fabric 234 or the second sheet of fabric 294 or both may comprise at least two layers laminated together to make a string 226. Either the first sheet of fabric 324 or the second sheet of fabric 294 or both may be made of multiple layers joined together, such as the fabric disclosed in U.S. patent application Ser. Nos. 15/062,595 and 15/584,402, for example. In some applications, some strings may be made with first and second sheets of fabric, each sheet comprising a single layer while other strings may be made with first and second sheets of fabric, each sheet of fabric comprising multiple layers joined together in any known manner, such as via lamination.

Any string or combination of strings shown or described herein may be incorporated into any pocketed spring assembly shown or described herein. Any pocketed spring assembly shown or described herein may be incorporated into any bedding or seating product, regardless of whether the product is a single-sided or double-sided mattress or a seating cushion.

The various embodiments of the invention shown and described are merely for illustrative purposes only, as the drawings and the description are not intended to restrict or limit in any way the scope of the claims. Those skilled in the art will appreciate various changes, modifications, and improvements which can be made to the invention without departing from the spirit or scope thereof. The invention in its broader aspects is therefore not limited to the specific details and representative apparatus and methods shown and described. Departures may therefore be made from such details without departing from the spirit or scope of the general inventive concept. The invention resides in each individual feature described herein, alone, and in all combinations of those features. Accordingly, the scope of the invention shall be limited only by the following claims and their equivalents.

What is claimed is:

1. A bedding or seating product comprising:

a pocketed spring assembly comprising a plurality of strings of springs, each of the strings comprising a piece of fabric folded to create first and second opposed plies of fabric on opposite sides of a row of springs and first and second tabs formed on opposite sides of the string, each of the strings being joined to at least one adjacent string by at least one longitudinal seam joining overlapping tabs of adjacent strings, a plurality of pockets formed along each string by separating seams, each of the pockets having approximately the same height, each of the separating seams having a length less than the height of the pockets;

at least one spring positioned in each of the pockets;

cushioning materials; and a cover encasing said pocketed spring assembly and cushioning materials.

2. A bedding or seating product comprising:

a pocketed spring assembly comprising a plurality of strings of springs, each of the strings comprising a piece of fabric folded to create first and second opposed plies of fabric on opposed sides of a row of springs and first and second tabs formed on opposed sides of the string, each of the strings being joined to at least one adjacent string by at least one longitudinal seam joining overlapping tabs of adjacent strings, a plurality of pockets formed along each string by separating seams, each of the pockets having approximately the same height, each of the separating seams having a length less than the height of the pockets.

3. The product of claim 2 wherein at least two longitudinal seams join overlapping tabs of adjacent strings.

4. The product of claim 2 wherein said strings extend longitudinally.

5. The product of claim 2 wherein said strings extend transversely.

6. The product of claim 1 wherein each of said pocketed springs has the same height.

7. The product of claim 6 wherein each of said separating seams has a length less than half the height of the pocketed springs.

8. The product of claim 6 wherein each of said springs is a coil spring.

9. A pocketed spring assembly for a bedding or seating product, said pocketed spring assembly comprising:

a plurality of strings of springs, each of the strings comprising a row of springs and a piece of fabric surrounding the row of springs, the piece of fabric being secured to itself with longitudinal seams and having opposed plies and opposed tabs on opposite sides of the springs, a plurality of pockets formed along each string of springs by first and second separating seams, each of the first and separating seams joining the opposed plies of fabric, at least one spring being positioned in each of the pockets, wherein each of the first separating seams is spaced from a corresponding second separating seam to partially open adjacent pockets, thereby allowing air to flow between the adjacent pockets, each of the strings being joined at least one adjacent string by at least one longitudinal seam joining overlapping tabs of adjacent strings.

10. The pocketed spring assembly of claim 9 wherein at least two longitudinal seams join overlapping tabs of adjacent strings.

11. The pocketed spring assembly of claim 9 wherein said strings extend longitudinally.

12. The pocketed spring assembly of claim 9 wherein said strings extend transversely.

13. The pocketed spring assembly of claim 9 wherein each of said pocketed springs has the same height.

14. The pocketed spring assembly of claim 13 wherein each of said first and second separating seams has a length less than half the height of the pocketed springs.

15. The pocketed spring assembly of claim 13 wherein each of said first and second separating seams has a length less than the height of the pocketed springs.

16. A pocketed spring assembly for a bedding or seating product, said pocketed spring assembly comprising:

a plurality of strings of springs, each of the strings comprising a piece of fabric folded to create opposed plies of fabric and opposed tabs on opposed sides of a row of springs, a plurality of pockets formed along each string by first and second separating seams, each of the first and separating seams joining the opposed plies of fabric, at least one spring being positioned in each of the pockets, wherein each of the first separating seams is spaced from a corresponding second separating seam to partially open adjacent pockets, thereby allowing air to flow between the adjacent pockets, at least one tab of each of the strings being joined to at least one tab of at least one adjacent string with longitudinal seams.

17. The pocketed spring assembly of claim 16 wherein two longitudinal seams join overlapping tabs of adjacent strings of springs.

18. The pocketed spring assembly of claim 16 wherein each of said pocketed springs has the same height.

19. The pocketed spring assembly of claim 18 wherein each of said first and second separating seams has a length less than half the height of the pocketed springs.

20. The pocketed spring assembly of claim 18 wherein each of said first and second separating seams has a length less than the height of the pocketed springs.

* * * * *